US011747752B2

(12) United States Patent
Noguchi et al.

(10) Patent No.: US 11,747,752 B2
(45) Date of Patent: Sep. 5, 2023

(54) IMAGE FORMING APPARATUS, BELT ADJUSTMENT METHOD AND NON-TRANSITORY COMPUTER-READABLE RECORDING MEDIUM ENCODED WITH BELT ADJUSTMENT PROGRAM

(71) Applicant: Konica Minolta, Inc., Tokyo (JP)

(72) Inventors: Hidetoshi Noguchi, Tahara (JP); Kazuki Shimizu, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/662,938

(22) Filed: May 11, 2022

(65) Prior Publication Data

US 2022/0373941 A1 Nov. 24, 2022

(30) Foreign Application Priority Data

May 19, 2021 (JP) ..... 2021-084902

(51) Int. Cl.
*G03G 15/00* (2006.01)
*G03G 15/16* (2006.01)
*G03G 15/08* (2006.01)

(52) U.S. Cl.
CPC ..... *G03G 15/1615* (2013.01); *G03G 15/0808* (2013.01); *G03G 2215/1623* (2013.01)

(58) Field of Classification Search
CPC ..... G03G 15/0808; G03G 15/1615
USPC ..... 399/119, 302, 303, 308, 165
See application file for complete search history.

(56) References Cited

U.S. PATENT DOCUMENTS

| | | | | |
|---|---|---|---|---|
| 9,063,472 | B2 * | 6/2015 | Sengoku | G03G 15/161 |
| 9,523,944 | B2 * | 12/2016 | Toso | G03G 15/1615 |
| 9,599,934 | B2 * | 3/2017 | Hozumi | G03G 15/1605 |
| 10,496,017 | B2 * | 12/2019 | Hozumi | G03G 15/0136 |
| 10,947,072 | B2 * | 3/2021 | Nakajima | G03G 15/02 |

FOREIGN PATENT DOCUMENTS

| | | |
|---|---|---|
| JP | H07-36314 A | 2/1995 |
| JP | 2017-111203 A | 6/2017 |

* cited by examiner

*Primary Examiner* — Hoan H Tran
(74) *Attorney, Agent, or Firm* — LUCAS & MERCANTI, LLP

(57) ABSTRACT

An image forming apparatus includes a developer that forms a toner image on an endless belt that is suspended over outer portions of a plurality of rollers, a driver that rotates at least one driving roller out of the plurality of rollers, a position adjustment mechanism that corrects relative positions of the plurality of rollers relative to one another, and a hardware processor, wherein the hardware processor controls the position adjustment mechanism to correct a relative position between the belt and the driving roller with tension applied to the belt being a second tension smaller than a first tension that is applied in a developing state in which a toner image is formed on the belt by the developer.

21 Claims, 11 Drawing Sheets

IMAGE FORMING APPARATUS, BELT ADJUSTMENT METHOD AND NON-TRANSITORY COMPUTER-READABLE RECORDING MEDIUM ENCODED WITH BELT ADJUSTMENT PROGRAM

The entire disclosure of Japanese patent Application No. 2021-084902 filed on May 19, 2021, is incorporated herein by reference in its entirety.

BACKGROUND

Technological Field

The present invention relates to an image forming apparatus, a belt adjustment method and a non-transitory computer-readable recording medium encoded with a belt adjustment program. In particular, the present invention relates to an image forming apparatus that fuses toner to a recording medium by applying pressure and heat to the recording medium, a belt adjustment method performed in the image forming apparatus and a non-transitory computer-readable recording medium encoded with a belt adjustment program that causes a computer controlling the image forming apparatus to perform the belt adjustment method.

Description of the Related Art

In an image forming apparatus such as a copying machine, a printer or a facsimile machine, a toner image obtained by development of an electrostatic latent image with toner is transferred to a transfer belt, and the toner image carried by the transfer belt is transferred to a recording medium such as a paper. The transfer belt is suspended over a plurality of rollers arranged in parallel to each other and rotated. Therefore, the transfer belt may deviate or meander with respect to a reference trajectory.

For example, Japanese Patent Laid-Open No. 2017-111203 A discloses a belt driving device that includes an endless belt, a tension roller that is one of a plurality of rollers with which the endless belt is stretched and around which the endless belt circulates, a frame member arranged at both ends in an axial direction of the tension roller, an arm member that is arranged at at least one of shaft ends of a rotation shaft of the tension roller, has a first end portion freely rotatably supported at the shaft end, has a second end portion freely rotatably supported at the frame member and supports the shaft end to be freely reciprocatable in one predetermined direction orthogonal to the axial direction, an elastic member that is arranged between the first end portion and the second end portion, and biases the shaft end in a direction such that tension of the endless belt increases, a meandering correcting mechanism that tilts the rotation shaft in the one direction in accordance with a displacement amount of the endless belt in the axial direction, and a restriction member that restricts movement of the shaft end in the one direction in a range in which a rotational center of the second end portion is arranged in the one direction with respect to a resultant-force direction of tension of the endless belt applied from the shaft end.

In the image forming apparatus described in Japanese Patent Laid-Open No. 2017-111203 A, because the rotation shaft is tilted in the one predetermined direction orthogonal to the axial direction in accordance with a displacement amount of the endless belt in the axial direction, the tension of the endless belt differs in the axial direction. However, because the shaft end of the rotation shaft that is not supported by the arm member does not move, the tension of the belt closer to the shaft end not supported by the arm member is the same as that before the rotation shaft is tilted in the one direction. Therefore, because the frictional force between the endless belt and the tension roller is maintained, the movement of the endless belt in the axial direction with respect to the inclination of the tension roller is prevented, and there is a problem that it takes a period of time to move the endless belt in the axial direction.

SUMMARY

According to one aspect of the present invention, an image forming apparatus includes a plurality of rollers, an endless belt that is suspended over outer portions of the plurality of rollers, a developer that forms a toner image on the belt, a driver that rotates at least one driving roller out of the plurality of rollers, a position adjustment mechanism that corrects relative positions of the plurality of rollers relative to one another, and a hardware processor, wherein the hardware processor controls the position adjustment mechanism to correct a relative position between the belt and the driving roller with tension applied to the belt being a second tension smaller than a first tension that is applied in a developing state in which a toner image is formed on the belt by the developer.

According to another aspect of the present invention, a belt adjustment method is to adjust an image forming apparatus, and the image forming apparatus includes a plurality of rollers, an endless belt that is suspended over the plurality of rollers, a developer that forms a toner image on the belt, a driver that rotates at least one driving roller out of the plurality of rollers, and a position adjustment mechanism that corrects relative positions of the plurality of rollers relative to one another, and the belt adjustment method causes the image forming apparatus to perform a position adjustment step of controlling the position adjustment mechanism to correct a relative position between the belt and the driving roller with tension applied to the belt being a second tension smaller than a first tension that is applied in a developing state in which a toner image is formed on the belt by the developer.

According to yet another aspect of the present invention, a non-transitory computer-readable recording medium encoded with a belt adjustment program executed in a computer controls an image forming apparatus, wherein the image forming apparatus includes a plurality of rollers, an endless belt that is suspended over the plurality of rollers, a developer that forms a toner image on the belt, a driver that rotates at least one driving roller out of the plurality of rollers, and a position adjustment mechanism that corrects relative positions of the plurality of rollers relative to one another, and the belt adjustment program causes the computer to perform a position adjustment step of controlling the position adjustment mechanism to correct a relative position between the belt and the driving roller with tension applied to the belt being a second tension smaller than a first tension that is applied in a developing state in which a toner image is formed on the belt by the developer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
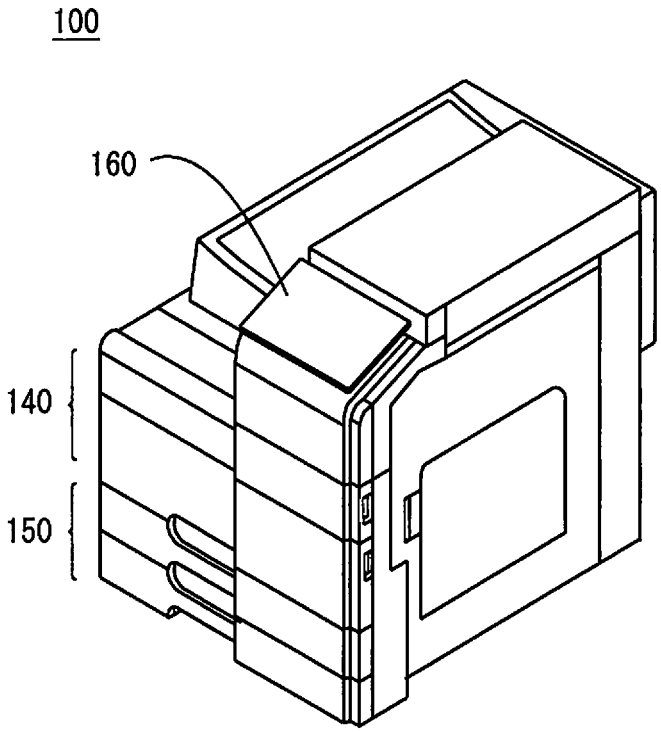
FIG. 1 is a perspective view showing the appearance of a printer in one embodiment of the present embodiment.

Hereinafter, one or more embodiments of the present invention will be described with reference to the drawings. However, the scope of the invention is not limited to the disclosed embodiments.

Embodiments of the present invention will be described below with reference to the drawings. In the following description, the same parts are denoted with the same reference characters. Their names and functions are also the same. Thus, a detailed description thereof will not be repeated.

First Embodiment

Figure 2:
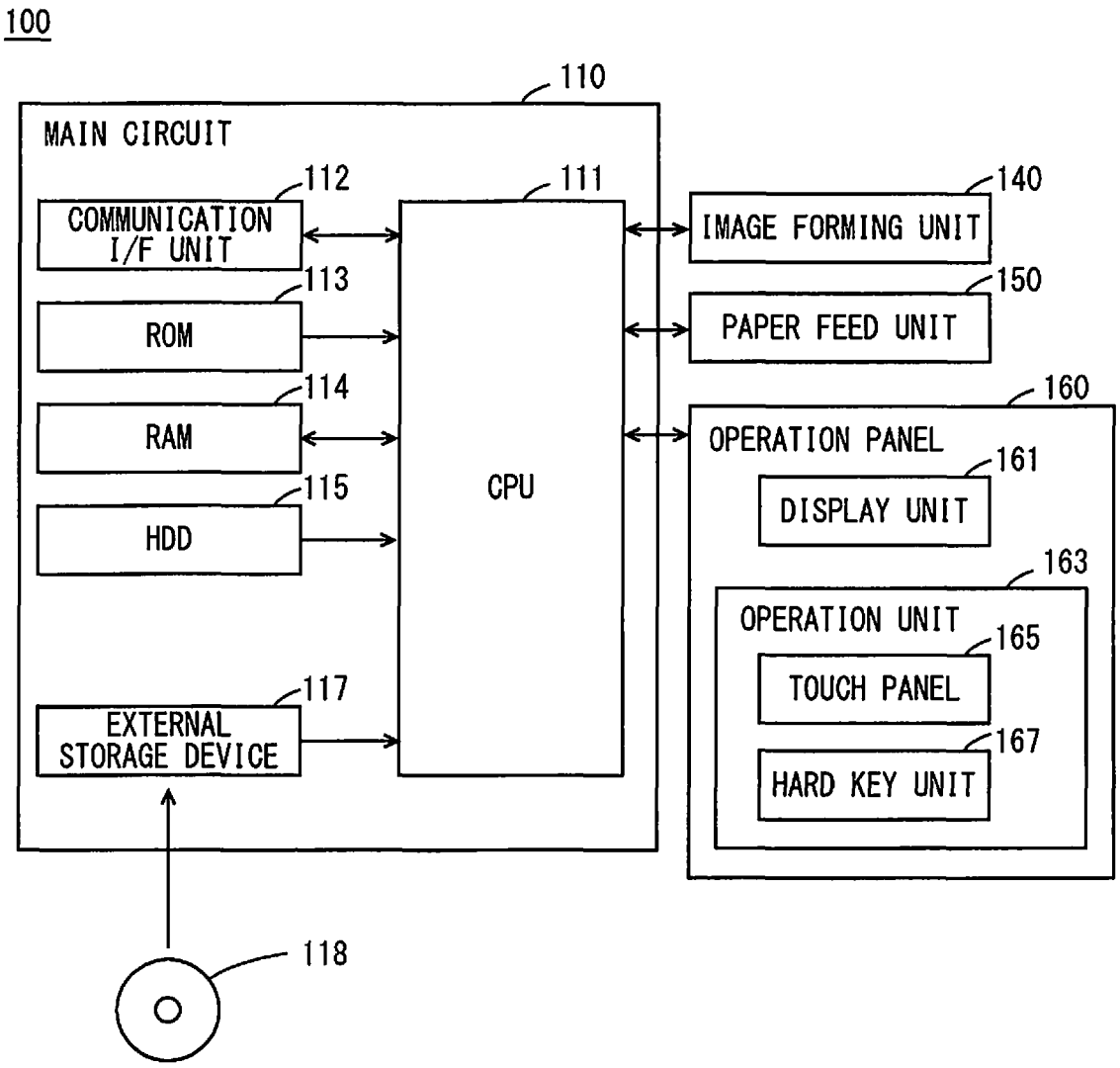
FIG. 2 is a block diagram showing one example of the hardware configuration of the printer.

FIG. 1 is a perspective view showing the appearance of a printer in one of embodiments of the present embodiment. FIG. 2 is a block diagram showing one example of the hardware configuration of the printer. Referring to FIGS. 1 and 2, the printer 100 is one example of an image forming apparatus and includes a main circuit 110, an image forming unit 140 for forming an image on a paper (a sheet of paper) based on image data, a paper feed unit 150 for supplying a paper to the image forming unit 140 and an operation panel 160 serving as a user interface.

The main circuit 110 includes a CPU (Central Processing Unit) 111 for controlling the printer 100 as a whole, a communication interface (I/F) unit 112, a ROM (Read Only Memory) 113, a RAM (Random Access Memory) 114, a Hard Disc Drive (HDD) 115 that is used as a mass storage device and an external storage device 117. The CPU 111 is connected to the image forming unit 140, the paper feed unit 150 and the operation panel 160, and controls the printer 100 as a whole.

The paper feed unit 150 transports papers stored in a paper feed cassette to the image forming unit 140. The image forming unit 140 is controlled by the CPU 111 and forms an image using a well-known electrophotographic technique, forms an image on a paper transported by the paper feed unit 150 based on the image data received from the CPU 111 and discharges the paper having an image formed thereon to a paper discharge tray 39 (see FIG. 3). The image data that is output by the CPU 111 to the image forming unit 140 includes image data such as print data received from an external personal computer or the like.

The ROM 113 stores a program to be executed by the CPU 111 or data required for execution of the program. The RAM 114 is used as a work area when the CPU 111 executes a program.

The operation panel 160 is provided on an upper surface of the printer 100. The operation panel 160 includes a display unit 161 and an operation unit 163. The display unit 161 is a Liquid Crystal Display (LCD) device, for example, and displays an instruction menu for a user, information about acquired image data, etc. As long as displaying images, an organic EL (Electroluminescence) display, for example, can be used instead of an LCD.

The operation unit 163 includes a touch panel 165 and a hard key unit 167. The hard key unit 167 includes a plurality of hard keys. The hard keys are contact switches, for example. The touch panel 165 detects a position designated by the user on the display surface of the display unit 161.

The communication OF unit 112 is an interface for connecting the printer 100 to a network. The communication I/F unit 112 communicates with another computer connected to the network using a communication protocol such as TCP (Transmission Control Protocol) or UDP (File Datagram Protocol). The network to which the communication I/F unit 112 is connected is a Local Area Network (LAN), either wired or wireless. Further, the network is not limited to a LAN and may be a Wide Area Network (WAN), a Public Switched Telephone Network (PSTN), the Internet or the like.

The external storage device 117 is controlled by the CPU 111 and mounted with a CD-ROM (Compact Disk Read Only Memory) 118 or a semiconductor memory. While the CPU 111 executes a program stored in the ROM 113 by way of example in the present embodiment, the CPU 111 may control the external storage device 117, read out a program to be executed by the CPU 111 from the CD-ROM 118 and store the read program in the RAM 114 for execution.

It is noted that a recording medium for storing a program to be executed by the CPU 111 is not limited to the CD-ROM 118. It may be a flexible disc, a cassette tape, an optical disc (MO (Magnetic Optical Disc)/MD (Mini Disc)/DVD (Digital Versatile Disc)), an IC card, an optical card, and a semiconductor memory such as a mask ROM and an EPROM (Erasable Programmable ROM). Further, the CPU 111 may download a program from a computer connected to the network and store the program in the HDD 115, or the computer connected to the network may write the program in the HDD 115. Then, the program stored in the HDD 115 may be loaded into the RAM 114 to be executed by the CPU 111. The program referred to here includes not only a program directly executable by the CPU 111 but also a source program, a compressed program, an encrypted program and the like.

Figure 3:
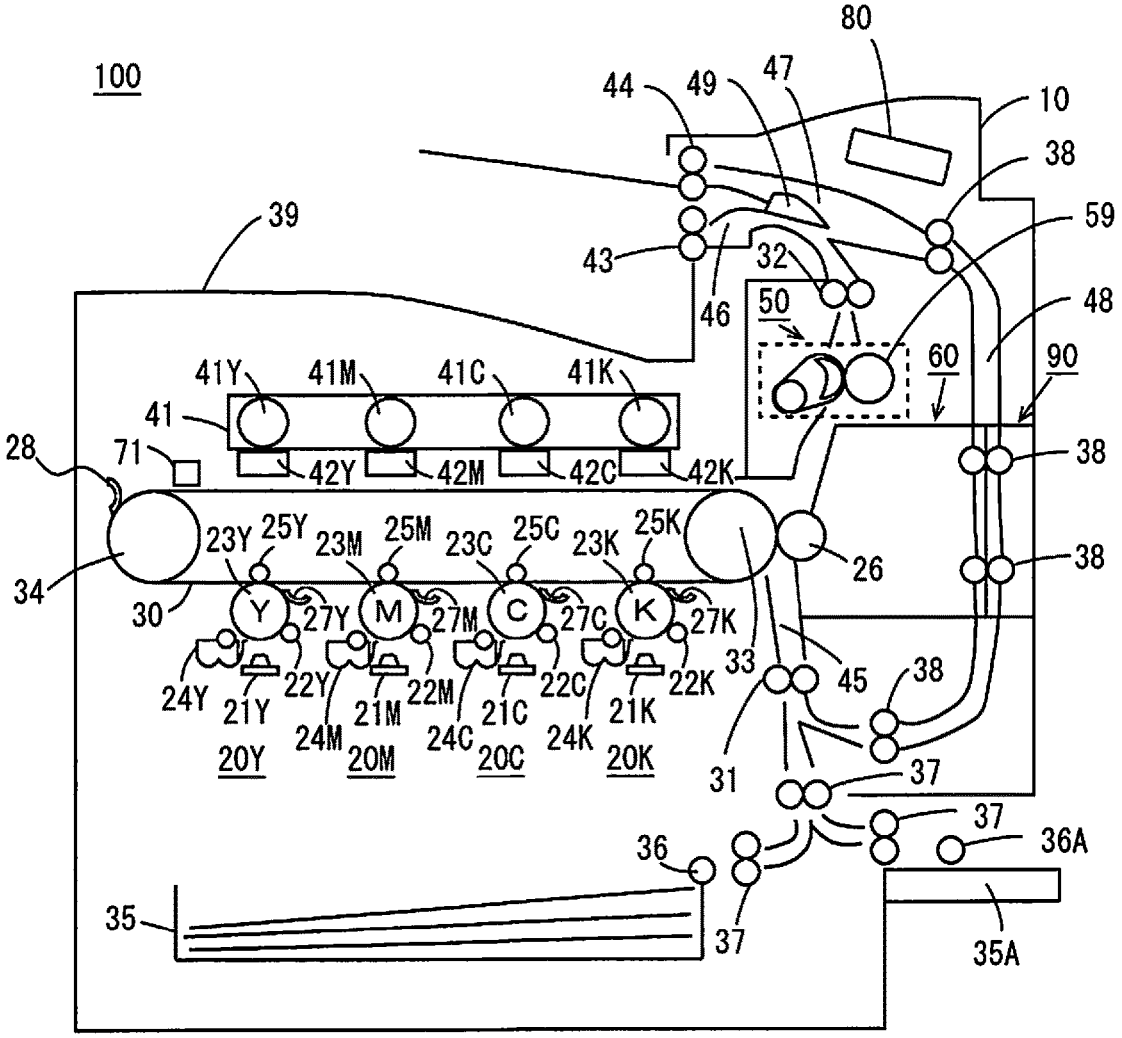
FIG. 3 is a cross sectional view schematically showing one example of the internal configuration of the printer.

FIG. 3 is a cross sectional view schematically showing one example of the internal configuration of the printer. For the sake of explanation, in the following description, the direction that extends to the left and right in FIG. 3 is referred to as a left-and-right direction, and the direction that extends to the front and rear in FIG. 3 is referred to as a depth direction. In regard to the left-and-right direction, the direction directed from the left to the right is referred to as a right-surface direction, and the direction directed from the right to the left is referred to as a left-surface direction. In regard to the depth direction, the direction directed from a front surface toward a rear surface is referred to as a rear-surface direction, and the direction directed from the rear surface toward the front surface is referred to as a front-surface direction.

The printer 100 includes respective image forming units 20Y, 20M, 20C, 20K for respective yellow, magenta, cyan and black. Here, "Y," "M," "C" and "K" represent yellow, magenta, cyan and black, respectively. At least one of the image forming units 20Y, 20M, 20C, 20K is driven, so that an image is formed. When all of the image forming units 20Y, 20M, 20C, 20K are driven, a full-color image is formed. The printing data for yellow, magenta, cyan and black are respectively input to the image forming units 20Y, 20M, 20C, 20K. The only difference among the image forming units 20Y, 20M, 20C, 20K is the color of toner used by the image forming units 20Y, 20M, 20C, 20K. Therefore, the image forming unit 20Y for forming an image in yellow will be described here.

The image forming unit 20Y includes an exposure device 21Y to which printing data for yellow is input, a photoreceptor drum 23Y which is an image carrier, a charging roller 22Y for uniformly charging the surface of the photoreceptor drum 23Y, a developer 24Y, a primary transfer roller 25Y for transferring toner images formed on the photoreceptor drum 23Y onto an intermediate transfer belt 30 which is an image carrier using the effect of an electric field force, a drum cleaning blade 27Y for removing transfer residual toner on the photoreceptor drum 23Y, a toner bottle 41Y and a toner hopper 42Y.

The toner bottle 41Y contains yellow toner. The toner bottle 41Y is rotated by a toner bottle motor that is used as a driving source to discharge the toner to the outside. The toner discharged from the toner bottle 41Y is supplied to the toner hopper 42Y. The toner hopper 42Y supplies the toner to the developer 24Y in response to a remaining amount of toner contained in the developer 24Y becoming equal to or smaller than a predetermined lower limit value.

Around the photoreceptor drum 23Y, the charging roller 22Y, the exposure device 21Y, the developer 24Y, the primary transfer roller 25Y and the drum cleaning blade 27Y are arranged in this order in the rotation direction of the photoreceptor drum 23Y. After being electrically charged by the charging roller 22Y, the photoreceptor drum 23Y is irradiated with laser light emitted by the exposure device 21Y. The exposure device 21Y forms an electrostatic latent image by exposing a portion corresponding to an image on the surface of the photoreceptor drum 23Y. Thus, the electrostatic latent image is formed on the photoreceptor drum 23Y. Subsequently, the developer 24Y develops the electrostatic latent image formed on the photoreceptor drum 23Y with the charged toner. Specifically, the toner is placed on the electrostatic latent image formed on the photoreceptor drum 23Y by the effect of an electric field force, whereby toner images are formed on the photoreceptor drum 23Y. The toner images formed on the photoreceptor drum 23Y are transferred onto the intermediate transfer belt 30, which is an image carrier, with the effect of an electric field force by the primary transfer roller 25Y. The toner remaining on the photoreceptor drum 23Y without being transferred is removed from the photoreceptor drum 23Y by the drum cleaning blade 27Y.

On the other hand, the intermediate transfer belt 30 is suspended by a driving roller 33 and a driven roller 34 so as not to loosen. When the driving roller 33 rotates in an anti-clockwise direction in FIG. 2, the intermediate transfer belt 30 rotates in the anti-clockwise direction in the diagram at a predetermined speed. The driven roller 34 rotates in the anti-clockwise direction due to the rotation of the intermediate transfer belt 30.

Thus, the image forming units 20Y, 20M, 20C, 20K sequentially transfer toner images onto the intermediate transfer belt 30. Timing for transferring toner images onto the intermediate transfer belt 30 by the respective image forming units 20Y, 20M, 20C, 20K is adjusted by detection of a reference mark provided on the intermediate transfer belt 30. Thus, toner images in yellow, magenta, cyan and black are superimposed on the intermediate transfer belt 30.

The toner images formed on the intermediate transfer belt 30 are transferred onto a paper with the effect of an electric field force by a secondary transfer roller 26 which is a transfer member. A paper transported by a timing roller 31 is transferred to a nip portion where the intermediate transfer belt 30 and the secondary transfer roller 26 are in contact with each other. A paper on which toner images are formed is transported to a fuser device 50 to be heated and pressed. Thus, the toner is fused and fixed to the paper. Thereafter, the paper is discharged to the paper discharge tray 39.

A belt cleaning blade 28 is provided at a position farther upstream than the image forming unit 20Y of the intermediate transfer belt 30. The belt cleaning blade 28 removes the toner remaining on the intermediate transfer belt 30 without being transferred to the paper.

While driving all of the image forming units 20Y, 20M, 20C, 20K in a case in which forming a full-color image, the printer 100 drives any one of the image forming units 20Y, 20M, 20C, 20K in a case in which forming a monochrome image. It is also possible to form an image by combining two or more of the image forming units 20Y, 20M, 20C, 20K. While using a tandem-system including the image forming units 20Y, 20M, 20C, 20K that respectively form toner on a paper in four colors, by way of example, the printer 100 may use a four-cycle system that sequentially transfers the toner of four colors onto the paper using one photoreceptor drum.

A plurality of papers are set in a paper feed cassette 35. The papers contained in the paper feed cassette 35 are sequentially supplied to a transport path one by one by a pickup roller 36 attached to the paper feed cassette 35 and are sent to the timing roller 31 by a paper feed roller 37. Further, in a case in which being set in a manual feed cassette 35A, one or more papers set in the manual feed cassette 35A are sequentially supplied to the transport path one by one by a take-out roller 36A attached to the manual feed cassette 35A and sent to the timing roller 31 by the paper feed roller 37.

The paper transport path includes an image forming path 45, a first transport path 46, a second transport path 47 and a front-back inverting path 48. The image forming path 45 is the path from the timing roller 31 to a path switching gate 49, and the secondary transfer roller 26 and the fuser device 50 are arranged in this order from the timing roller 31. The timing roller 31 sends a paper that is transported from the paper feed cassette 35 or the manual feed cassette 35A to the image forming path 45. The timing roller 31 starts transporting the paper such that the paper arrives at the secondary transfer roller 26 when a toner image that is formed on the intermediate transfer belt 30 arrives at the secondary transfer roller 26. The paper transported by the timing roller 31 is pressed against the intermediate transfer belt 30 by the secondary transfer roller 26, and toner images in yellow, magenta, cyan and black that are formed on the intermediate transfer belt 30 in a superimposed manner are transferred to the paper.

The paper transported from the secondary transfer roller 26 is transported to the fuser device 50. The fuser device 50 heats and presses the paper. Thus, the toner is fixed to the paper. Thereafter, the paper is transported to any one of the first transport path 46 and the second transport path 47 by the path switching gate 49.

The first transport path 46 is the path from the path switching gate 49 to a paper discharge roller 43. The paper transported to the first transport path 46 is discharged to the paper discharge tray 39 by the paper discharge roller 43.

The second transport path 47 is the path from the path switching gate 49 to an inverting roller 44. The second transport path 47 is connected to the image forming path 45 and the front-back inverting path 48 at the path switching gate 49. A paper entering the second transport path 47 from the path switching gate 49 is transported to the inverting roller 44. The inverting roller 44 performs three operations: a waiting operation, an inverting operation and a paper discharging operation. In a case in which performing the waiting operation, the inverting roller 44 rotates forward and stops after a predetermined period of time elapses since the timing roller 31 is driven. Thus, the inverting roller 44 holds a paper that enters from the path switching gate 49 with the rear-surface end of the paper passing through the path switching gate 49. The inverting roller 44 performs the inverting operation after the waiting operation. In a case in which performing the inverting operation, the inverting roller 44 rotates in reverse and transports the held paper toward the path switching gate 49. Thus, the paper is transported through the second transport path 47 by the inverting roller 44 and guided to the front-back inverting path 48 by the path switching gate 49. Further, in a case in which performing the discharging operation, the inverting roller 44 rotates forward and discharges a paper to the paper discharge tray 39.

The front-back inverting path 48 is the path connecting the path switching gate 49 and the timing roller 31 in the image forming path 45 to each other. A paper entering the front-back inverting path 48 from the path switching gate 49 is transported to the timing roller 31 by a transport roller 38. Therefore, an image is formed on the front surface of the paper while the paper passes through the image forming path 45 for the first time, and an image is formed on the rear surface of the paper while the paper passes through the image forming path 45 again via the front-back inverting path 48. The paper having the image formed on the rear surface is guided to the first transport path 46 by the path switching gate 49 and discharged to the paper discharge tray 39.

Figure 4:
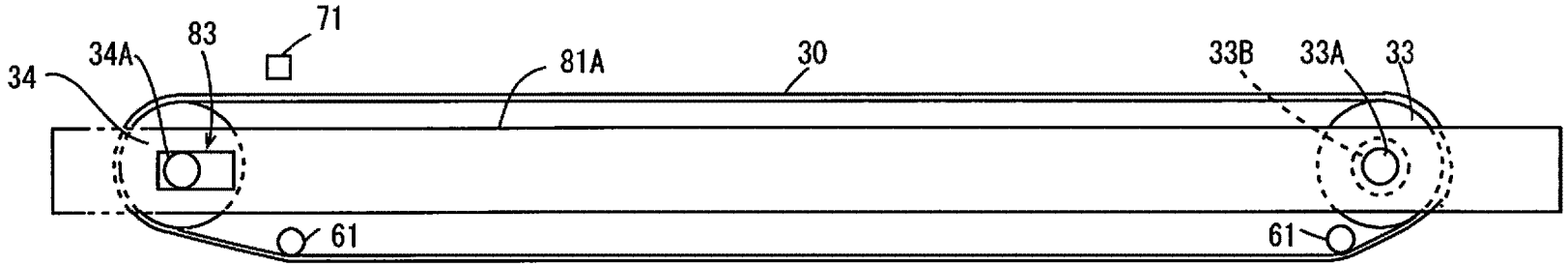
FIG. 4 is a diagram showing one example of a suspension state of an intermediate transfer belt.

FIG. 4 is a diagram showing one example of a suspension state of the intermediate transfer belt. FIG. 4 is a diagram of the intermediate transfer belt 30 as viewed from the front in the rear-surface direction. Referring to FIG. 4, the intermediate transfer belt 30 is an endless belt. The intermediate transfer belt 30 is suspended over the driving roller 33, the driven roller 34 and two tension rollers 61, 63 which are arranged in its inner periphery. Each of the driving roller 33 and the tension rollers 61, 63 has a rotation shaft supported by a main body frame. The rotation shaft of each of the tension rollers 61, 63 may be movable with respect to the main body frame when tension of the intermediate transfer belt 30 is adjusted. After adjustment of the tension of the intermediate transfer belt 30 is completed, the rotation shaft of each of the tension rollers 61, 63 is fixed to the main body frame.

A support plate 81A and a support plate 81B (see FIG. 6) are arranged in the front-surface direction and the rear-surface direction with the intermediate transfer belt 30 interposed therebetween. The support plate 81A is arranged closer to the front surface at a predetermined distance from the intermediate transfer belt 30, and the support plate 81B is arranged closer to the rear surface at a predetermined distance from the intermediate transfer belt 30. The support plate 81A and the support plate 81B are parts of the main body frame.

The both end portions of a rotation shaft 33A of the driving roller 33 are rotatably and respectively supported by the support plate 81A and the support plate 81B. One end of the rotation shaft 33A is connected to a driving motor 33B. When the driving motor 33B is driven, its driving force is transmitted to the rotation shaft 33A, and the driving roller 33 is rotated.

The both end portions of a rotation shaft 34A of the driven roller 34 are respectively inserted into sliding holes 83 respectively formed in the support plate 81A and the support plate 81B. A sliding hole 83 is rectangular, its length in the vertical direction is slightly larger than the diameter of the rotation shaft 33A and its length in the horizontal direction is larger than the diameter of the rotation shaft 33A. Therefore, the rotation shaft 34A of the driven roller 34 is slidable in the horizontal direction in the sliding hole 83. Hereinafter, out of the both end portions of the rotation shaft 34A of the driven roller 34, the end portion supported by the support plate 81A is referred to as a front-surface end, and the end portion supported by the support plate 81B is referred to as a rear-surface end.

The printer 100 includes a position adjustment mechanism that corrects the relative positions of the driven roller 34 and the driving roller 33 relative to each other. The position adjustment mechanism moves the both end portions of the rotation shaft 34A of the driven roller 34 along the sliding holes 83.

Figure 5:
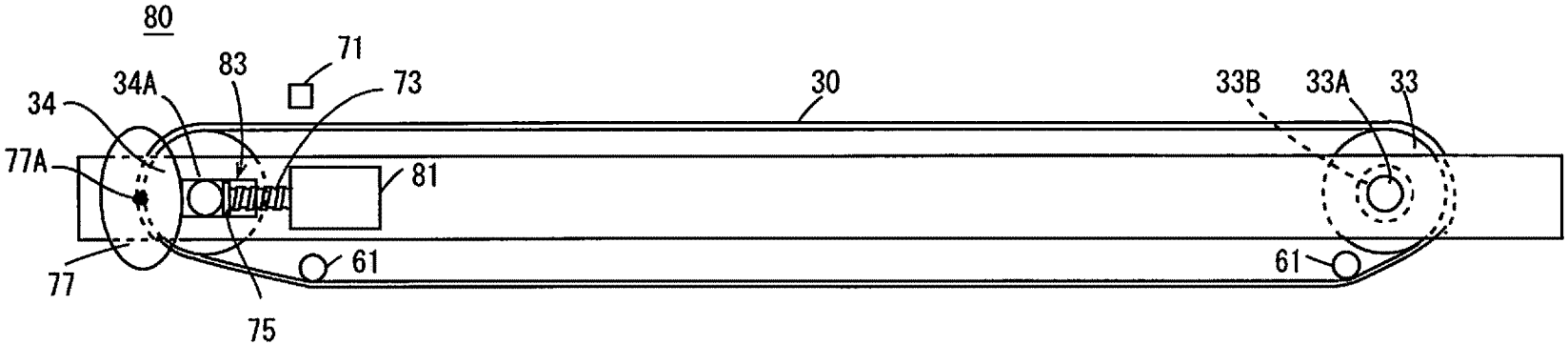
FIG. 5 is a first diagram showing one example of a position adjustment mechanism.
Figure 6:
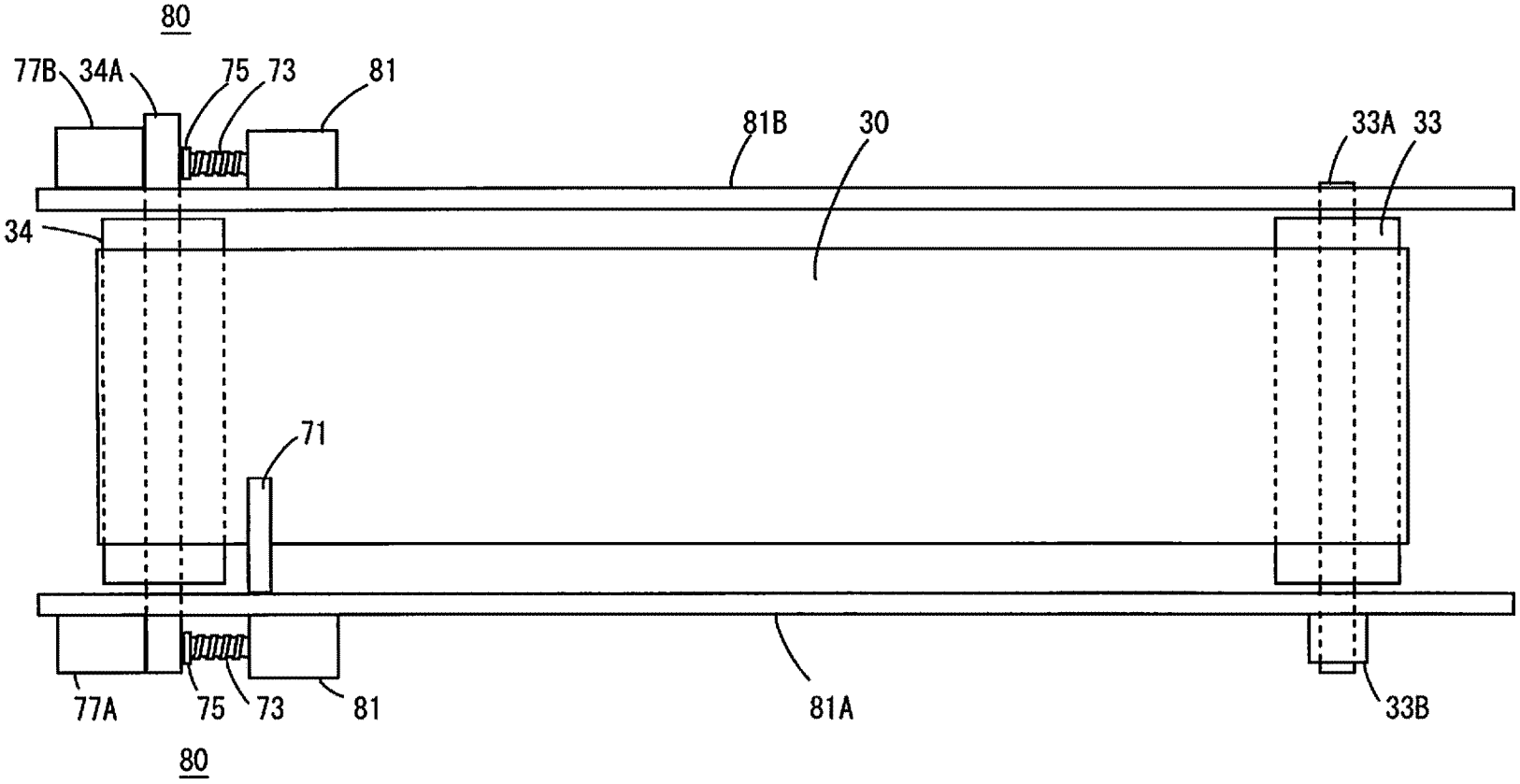
FIG. 6 is a second diagram showing one example of the position adjustment mechanism.

FIG. 5 is a first diagram showing one example of the position adjustment mechanism. FIG. 5 is a front view of the driven roller 34 as viewed from the front surface in the rear-surface direction. FIG. 6 is a second diagram showing one example of the position adjustment mechanism. FIG. 6 is a plan view of the driven roller 34 as viewed from above. Referring to FIGS. 5 and 6, the position adjustment mechanism 80 includes a cam 77, a support base 81, an elastic member 73 and the sliding holes 83. The cam 77 and the support base 81 are attached to each of the support plates 81A, 81B. The cam 77 has a rotation shaft 77A arranged at the center of gravity, and the rotation shaft 77A is rotatably supported by the respective support plates 81A, 81B. The rotation shaft 77A is supported by the respective support plates 81A, 81B at positions farther leftward than the sliding holes 83. The support base 81 is fixed to the respective support plates 81A, 81B at positions farther rightward than the sliding holes 83. Therefore, the sliding holes 83 are located between the rotation shaft 77A of the cam 77 and the support base 81.

One end of the elastic member 73 is fixed to the side surface of the support base 81 facing the cam 77. A contact portion 75 is fixed to the other end of the elastic member 73. The contact portion 75 abuts against the rotation shaft 34A of the driven roller 34 and slidably holds the rotation shaft 34A. The elastic member 73 biases the contact portion 75 toward the rotation shaft 77A of the cam 77. Therefore, the rotation shaft 34A is biased by the elastic member 73 toward the rotation shaft 77A of the cam 77. Note that the contact portion 75 may be a bearing that supports the rotation shaft 34A of the driven roller 34.

The cam 77 is supported by the respective support plates 81A, 81B so as to be rotatable about the rotation shaft 77A. The cam 77 is arranged at a position at which the cam 77 comes into contact with the rotation shaft 34A of the driven roller 34 and is rotated by a motor (not shown). The outer periphery of the cam 77 is oval. Therefore, the distances between the rotation shaft 77A and the portion at which the cam 77 comes into contact with the rotation shaft 34A of the driven roller 34 vary depending on the rotation angle of the cam 77. Therefore, when the cam 77 rotates, both end portions of the rotation shaft 34A slide in the sliding holes 83. In the present embodiment, the both end portions of the rotation shaft 34A are moved to three different positions, by way of example. The three different positions include an image forming position for a developing state in which the image forming unit 140 forms an image, and a first waiting position and a second waiting position for a non-developing state. The distance between the first waiting position and the rotation shaft 77A of the cam 77 is longer than the distance between the second waiting position and the rotation shaft 77A of the cam 77.

The cam 77 supported by the support plate 81A and the cam 77 supported by the support plate 81B are independently rotatable. Therefore, in regard to the both end portions of the rotation shaft 34A of the driven roller 34, both of the two end portions may be at the image forming positions, or one end portion may be at the first waiting position and the other end portion may be at the second waiting position.

The length of the intermediate transfer belt 30 in a front-and-rear direction, in other words, the width is shorter than the length of each of the driving roller 33 and the driven roller 34 in the front-and-rear direction. Therefore, the intermediate transfer belt 30 is movable in a direction parallel to the rotation shaft 33A of the driving roller 33. The driven roller 34 is a position adjustment roller for correcting the relative position between the intermediate transfer belt 30 and the driving roller 33.

As shown in FIG. 6, a sensor 71 is fixed to the side surface of the support plate 81A closer to the rear surface. The sensor 71 is a photoelectric sensor including a light source and a light receiver that receives light emitted from the light source. The light receiver has a light receiving surface extending in the front-and-rear direction. The sensor 71 is arranged at a position at which the end portion of the intermediate transfer belt 30 closer to the front surface intersects the light receiving surface in the vertical direction. A plurality of optoelectronic transducers are arranged in the front-and-rear direction on the light receiving surface. The sensor 71 detects a light receiving amount of each of the plurality of optoelectronic transducers and outputs the amount to the CPU 111. Note that the sensor 71 may be a transmissive photoelectric sensor instead of a reflective photoelectric sensor. Further, as long as the intermediate transfer belt 30 can be detected, an ultrasonic sensor, a magnetic sensor or the like may be used instead of the photoelectric sensor.

Figure 7:
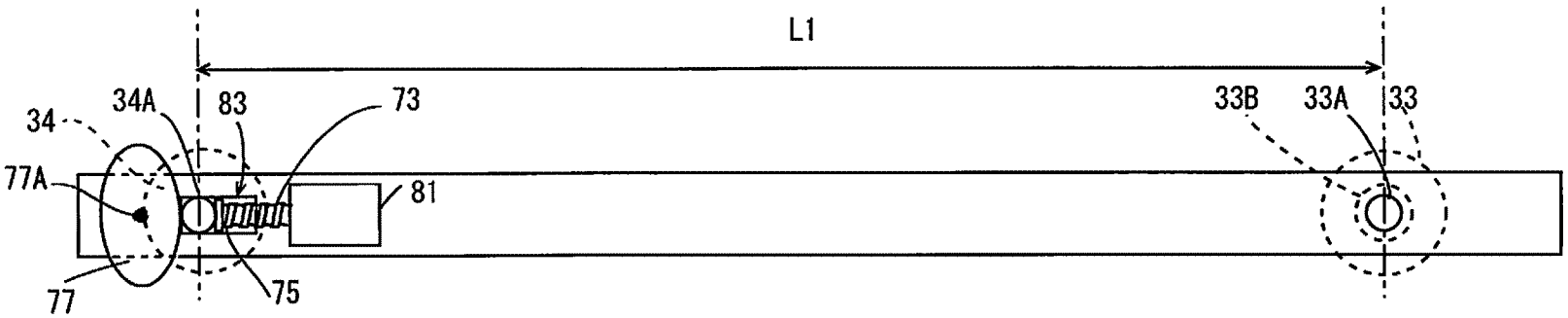
FIG. 7 is a diagram showing one example of the positions of a driven roller and a cam in regard to an image forming position.

FIG. 7 is a diagram showing one example of the positions of the driven roller and the cam when the rotation shaft 34A is located at the image forming position. In FIG. 7, the positional relationship between the cam 77 provided at the support plate 81A and the driven roller 34 is shown. Referring to FIG. 7, in a case in which the front-surface end of the rotation shaft 34A of the driven roller 34 is located at the image forming position, the cam 77 is located at a position at which the distance between the rotation shaft 77A and the rotation shaft 34A of the driven roller 34 is the shortest. The rotation angle of the cam 77 in a case in which the rotation shaft 34A of the driven roller 34 is located at the image forming position is 0 degrees. Hereinafter, the position of the cam 77 is indicated by a rotation angle, and the position of the cam 77 shown in FIG. 7 is referred to as a position of the rotation angle of 0 degrees. In a case in which each of the two cams 77 is located at the position of the rotation angle of 0 degrees, the both end portions of the rotation shaft 34A of the driven roller 34 are located at the image forming positions. In a case in which the cam 77 is located at the position of the rotation angle of 0 degrees, a distance L1 between the rotation shaft 34A of the driven roller 34 and the rotation shaft 33A of the driving roller 33 is at its maximum. Thus, tension of the intermediate transfer belt 30 is at its maximum. The tension of the intermediate transfer belt 30 in a case in which each of the two cams 77 is located at the position of the rotation angle of 0 degrees is referred to as a first tension.

Figure 8:
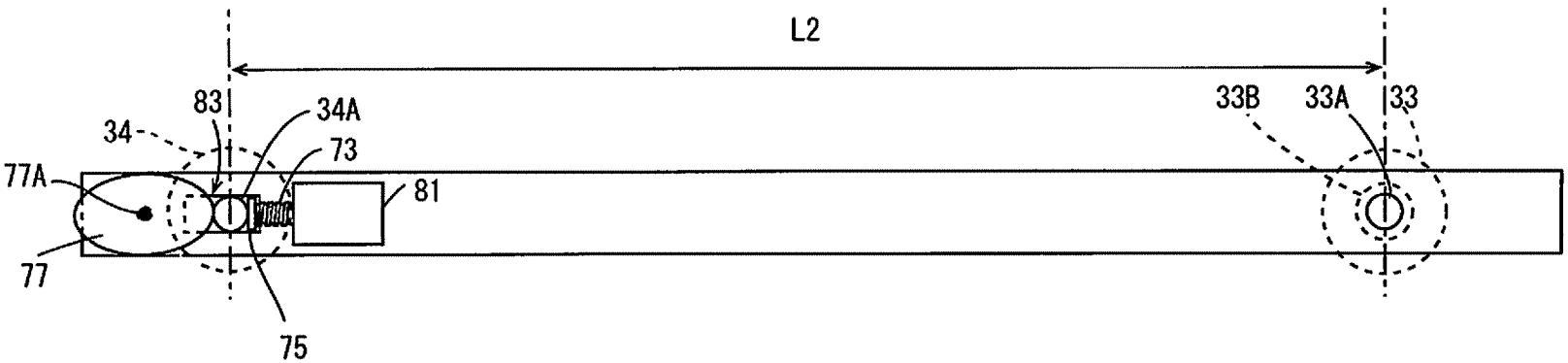
FIG. 8 is a diagram showing one example of the positions of the driven roller and the cam in regard to a first waiting position.

FIG. 8 is a diagram showing one example of the positions of the driven roller and the cam when the rotation shaft 34A is located at the first waiting position. In FIG. 8, the positional relationship between the cam 77 provided at the support plate 81A and the driven roller 34 is shown. Referring to FIG. 8, in a case in which the rotation shaft 34A of the driven roller 34 is located at the first waiting position, the cam 77 is located at a position at which the distance between the rotation shaft 77A and the rotation shaft 34A of the driven roller 34 is the longest. The rotation angle of the cam 77 in a case in which the rotation shaft 34A of the driven roller 34 is located at the first waiting position is 90 degrees. Hereinafter, the position of the cam 77 shown in FIG. 8 is referred to as a position of the rotation angle of 90 degrees. In a case in which the cam 77 provided at the support plate 81A is located at the position of the rotation angle of 90 degrees, the front-surface end of the rotation shaft 34A of the driven roller 34 is located at the first waiting position. In a case in which the cam 77 provided at the support plate 81B is located at the position of the rotation angle of 90 degrees, the rear-surface end of the rotation shaft 34A of the driven roller 34 is located at the first waiting position. In a case in which the cam 77 provided at the support plate 81A is located at the rotation angle of 90 degrees, a distance L2 between the front-surface end of the rotation shaft 34A of the driven roller 34 and the rotation shaft 33A of the driving roller 33 is the shortest. Thus, tension of the intermediate transfer belt 30 is at its minimum.

Figure 9:
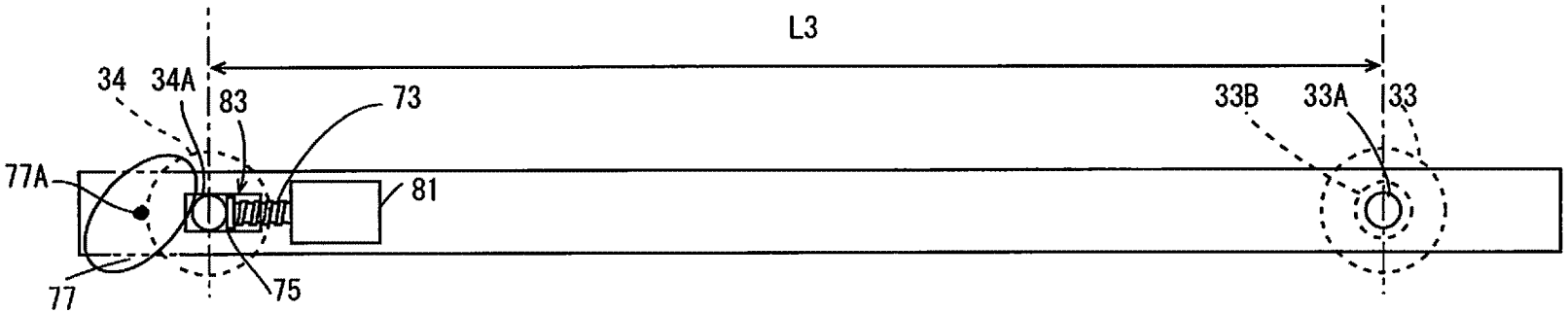
FIG. 9 is a diagram showing one example of the positions of the driven roller and the cam in regard to a second waiting position.

FIG. 9 is a diagram showing one example of the positions of the driven roller and the cam when the rotation shaft 34A is located at the second waiting position. In FIG. 9, the positional relationship between the cam 77 provided at the support plate 81B and the driven roller 34 is shown. In a case in which the rotation shaft 34A of the driven roller 34 is located at the second waiting position, the cam 77 is located between the position of the rotation angle of 0 degrees and the position of the rotation angle of 90 degrees. Therefore, the second waiting position is located between the image forming position and the first waiting position. Here, in a case in which the rotation shaft 34A of the driven roller 34 is located at the second waiting position, the rotation angle of the cam 77 is 45 degrees. Hereinafter, the position of the cam 77 shown in FIG. 9 is referred to as a position of the rotation angle of 45 degrees. In a case in which the cam 77 provided at the support plate 81A is located at the position of the rotation angle of 45 degrees, the front-surface end of the rotation shaft 34A of the driven roller 34 is located at the second waiting position. In a case in which the cam 77 provided at the support plate 81B is located at the position of the rotation angle of 45 degrees, the rear-surface end of the rotation shaft 34A of the driven roller 34 is located at the second waiting position. The length of the distance L3 between the front-surface end of the rotation shaft 34A of the driven roller 34 and the rotation shaft 33A of the driving roller 33 in a case in which the cam 77 provided at the support plate 81A is located at the position of the rotation angle of 45 degrees is between the distance L1 in a case in which the front-surface end is located at the image forming position and the distance L2 in a case in which the front-surface end is located at the first waiting position. Therefore, when each of the two cams 77 is at the position of the rotation angle of 45 degrees, the tension of the intermediate transfer belt 30 is intermediate. The tension of the intermediate transfer belt 30 in a case in which each of the two cams 77 is at the position of the rotation angle of 45 degrees is referred to as a second tension. The second tension is smaller than the first tension.

In a case in which each of the front-surface end and the rear-surface end of the rotation shaft 34A of the driven roller 34 is located at the image forming position, in other words, a case in which each of the two cams 77 is located at the position of the rotation angle of 0 degrees, the two cams 77 are adjusted such that the rotation shaft 34A of the driven roller 34 and the rotation shaft 33A of the driving roller 33 are parallel to each other.

In a case in which each of the front-surface end and the rear-surface end of the rotation shaft 34A of the driven roller 34 is located at the second waiting position, in other words, a case in which each of the two cams 77 is located at the position of the rotation angle of 45 degrees, the rotation shaft 34A of the driven roller 34 and the rotation shaft 33A of the driving roller 33 are parallel to each other. Further, in this case, the distance L3 between the rotation shaft 33A of the driven roller 34 and the rotation shaft 33A of the driving roller 33 is shorter than the distance L1 in a case in which each of the front-surface end and the rear-surface end of the rotation shaft 34A of the driven roller 34 is located at the image forming position. Therefore, the second tension applied to the intermediate transfer belt 30 in a case in which each of the front-surface end and the rear-surface end of the rotation shaft 34A of the driven roller 34 is located at the second waiting position is smaller than the first tension applied to the intermediate transfer belt 30 in a case in which each of the front-surface end and the rear-surface end of the rotation shaft 34A of the driven roller 34 is located at the image forming position.

In a case in which any one of the front-surface end and the rear-surface end of the rotation shaft 34A of the driven roller 34 is located at the second waiting position and the other one is located at the first waiting position, in other words, a case in which one of the two cams 77 is located at the rotation angle of 45 degrees and the other one is located at the rotation angle of 90 degrees, the rotation shaft 34A of the driven roller 34 and the rotation shaft 33A of the driving roller 33 are twisted relative to each other and not parallel to each other. Also in this case, the movement amounts of the front-surface end and the rear-surface end of the rotation shaft 34A of the driven roller 34 are adjusted such that the intermediate transfer belt 30 receives tension from the driving roller 33, the driven roller 34 and the tension rollers 61, 63. In other words, the size of the cam 77 is determined based on the movement amounts of the front-surface end and the rear-surface end of the rotation shaft 34A of the driven roller 34.

Figure 10:
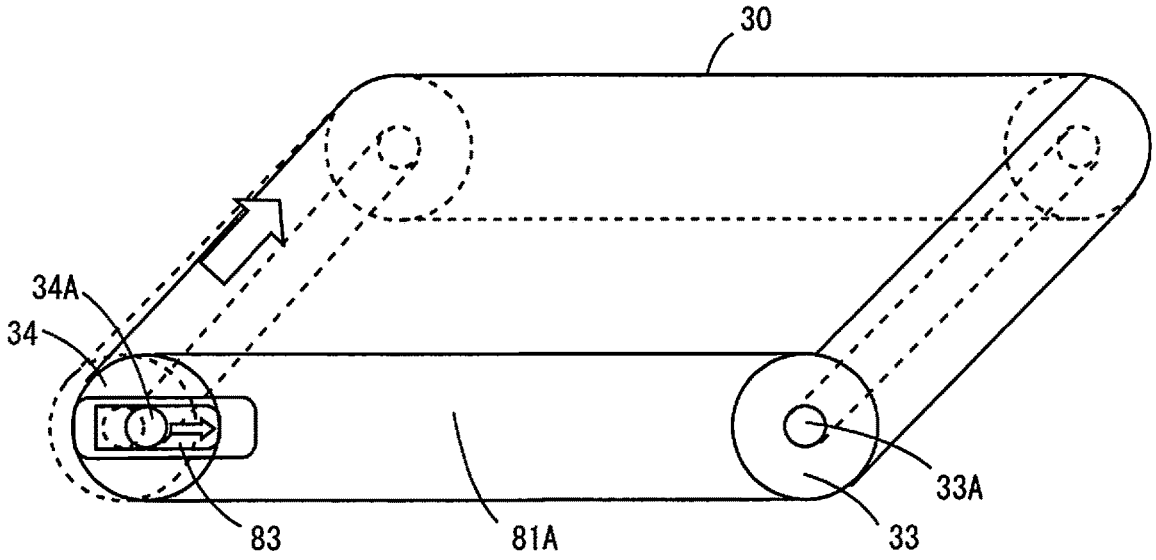
FIG. 10 is a schematic view for explaining the relative positions of a driving roller and the driven roller relative to each other and the moving direction of the intermediate transfer belt.

FIG. 10 is a schematic view for explaining the relative positions of the driving roller and the driven roller relative to each other and the moving direction of the intermediate transfer belt. Referring to FIG. 10, the front-surface end of the rotation shaft 34A of the driven roller 34 is located at the first waiting position, and the rear-surface end thereof is located at the second waiting position. In this case, the rotation shaft 34A of the driven roller 34 and the rotation shaft 33A of the driving roller 33 have a twisted positional relationship. Further, the tension of the intermediate transfer belt 30 is smaller in the portion closer to the front surface than the portion closer to the rear surface. In this state, when the driving roller 33 rotates, the intermediate transfer belt 30 moves in the rear-surface direction.

Contrary to the position of the driven roller 34 shown in FIG. 10, in a case in which the front-surface end of the rotation shaft 34A of the driven roller 34 is located at the second waiting position, and the rear-surface end thereof is located at the first waiting position, the rotation shaft 34A of the driven roller 34 and the rotation shaft 33A of the driving roller 33 have a twisted positional relationship. Further, the tension of the intermediate transfer belt 30 is larger in the portion closer to the front surface than the portion closer to the rear surface. In this state, when the driving roller 33 rotates, the intermediate transfer belt 30 moves in the front-surface direction.

In this manner, when the both end portions of the rotation shaft 34A of the driven roller 34 move, the intermediate transfer belt 30 moves in the front-surface direction or the rear-surface direction.

Figure 11:
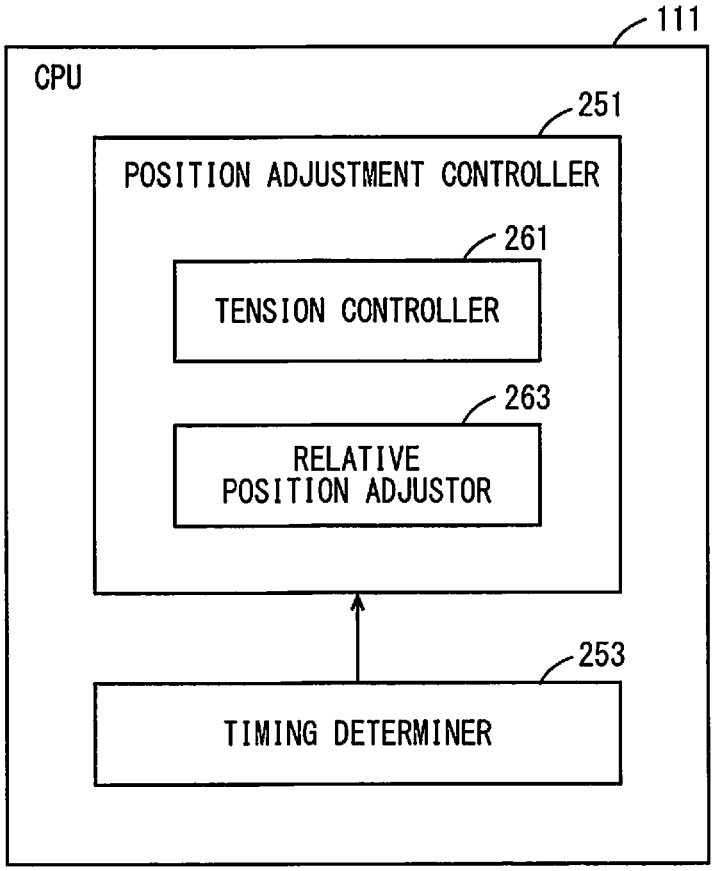
FIG. 11 is a block diagram showing one example of functions of a CPU included in the printer in the present embodiment.

FIG. 11 is a block diagram showing one example of functions of a CPU included in the printer in the present embodiment. The functions shown in FIG. 11 are the functions implemented by execution of a belt adjustment program stored in the ROM 113, the HDD 115 or the CD-ROM 118 by the CPU included in the printer 100. Referring to FIG. 11, the CPU 111 included in the printer 100 includes a position adjustment controller 251 and a timing determiner 253. The position adjustment controller 251 corrects the relative position of the intermediate transfer belt 30 with respect to the driving roller 33. The timing determiner 253 determines a point in time at which the position adjustment controller 251 adjusts the position of the rotation shaft 34A.

In a case in which the image forming unit 140 is not in the developing state where images are being formed by the image forming unit 140, the timing determiner 253 causes the position adjustment controller 251 to adjust the position of the rotation shaft 34A. The developing state is a state in which at least one of the image forming units 20Y, 20M, 20C, 20K respectively including the developers 24Y, 24M, 24C, 24 K transfers a toner image onto the intermediate transfer belt 30.

The developing state includes a case in which at least one of the image forming units 20Y, 20M, 20C, 20K transfers a toner image onto the intermediate transfer belt 30. Therefore, the period of the developing state includes a period in which only the image forming unit 20K transfers a toner image onto the intermediate transfer belt 30, and the image forming units 20Y, 20M, 20C do not transfer toner images onto the intermediate transfer belt 30, for example. In this case, the primary transfer rollers 25Y, 25M, 25C of the image forming units 20Y, 20M, 20C may be separated from the intermediate transfer belt 30.

The timing determiner 253 determines a point in time at which the position adjustment controller 251 adjusts the position of the rotation shaft 34A based on the relative position of the intermediate transfer belt 30 with respect to the driving roller 33. The timing determiner 253 detects the relative position of the intermediate transfer belt 30 with respect to the driving roller 33 based on the output of the sensor 71. Specifically, the timing determiner 253 determines the deviation between a reference line parallel to the rotation direction of the intermediate transfer belt 30 and a reference position based on the output of the sensor 71.

In the present embodiment, the reference line is an end portion of the intermediate transfer belt 30 closer to the front surface. The reference position is the position of the reference line when the center of the intermediate transfer belt 30 overlaps with the center of the driving roller 33 in a direction parallel to the rotation shaft 33A of the driving roller 33. Therefore, the deviation between the reference line and the reference position is represented by the distance between the reference line and the reference position in either one of the forward direction and the rearward direction of the reference line. Specifically, the deviation between the reference line and the reference position includes the direction in which the reference line deviates from the reference position and a deviation amount by which the reference line deviates from the reference position. The deviation amount is the distance between the reference line and the reference position.

The timing determiner 253 detects the deviation between the reference line and the reference position based on the output of the sensor 71. As described above, the sensor 71 outputs a light receiving amount representing an amount of light received by each of the plurality of optoelectronic transducers arranged in the front-and-rear direction. The timing determiner 253 specifies the position of the reference line by specifying an optoelectronic transducer that receives light reflected from the intermediate transfer belt 30 and an optoelectronic transducer that does not receive light reflected from the intermediate transfer belt 30 based on the output of the sensor 71.

The timing determiner 253 determines the deviation between the reference line and the reference position based on a light receiving amount received from the sensor 71 at an arbitrary point in time during the period of the non-developing state. The timing determiner 253 determines a point in time at which the distance between the reference line and the reference position becomes equal to or larger than a threshold value TH as a point in time at which the position adjustment controller 251 adjusts the position of the rotation shaft 34A. The timing determiner 253 outputs an adjustment instruction to the position adjustment controller 251 in response to the distance between the reference line and the reference position becoming equal to or larger than the threshold value TH. The adjustment instruction includes the direction in which the reference line deviates from the reference position.

The position adjustment controller 251 corrects the relative position of the intermediate transfer belt 30 with respect to the driving roller 33 in response to receiving the adjustment instruction from the timing determiner 253. The position adjustment controller 251 includes a tension controller 261 and a relative position adjuster 263. In response to receiving the adjustment instruction from the timing determiner 253, the tension controller 261 reduces the tension of the intermediate transfer belt 30 from the first tension to the second tension. Specifically, the tension controller 261 rotates each of the cam 77 supported by the support plate 81A and the cam 77 supported by the support plate 81B to the position of the rotation angle of 45 degrees. Thus, both ends of the rotation shaft 34A of the driven roller 34 move from the image forming positions to the second waiting positions.

In response to receiving the adjustment instruction from the timing determiner 253, the relative position adjuster 263 corrects the relative position between the intermediate transfer belt 30 and the rotation shaft 33A of the driving roller 33. Specifically, the relative position adjuster 263 rotates one of the cam 77 supported by the support plate 81A and the cam 77 supported by the support plate 81B to the position of the rotation angle of 90 degrees. The relative position adjuster 263 selects one of the cam 77 supported by the support plate 81A and the cam 77 supported by the support plate 81B based on a deviation direction included in the adjustment instruction.

In a case in which the deviation direction is the front-surface direction, the relative position adjuster 263 rotates the cam 77 supported by the support plate 81A closer to the front surface to the position of the rotation angle of 90 degrees. Thus, because the tension in a portion of the intermediate transfer belt 30 closer to the rear surface is larger than the tension in a portion of the intermediate transfer belt 30 closer to the front surface, the intermediate transfer belt 30 moves toward the rear surface while rotating and receiving motive power from the driving roller 33. In a case in which the deviation direction is the rear-surface direction, the relative position adjuster 263 rotates the cam 77 supported by the support plate 81A closer to the rear surface to the position of the rotation angle of 90 degrees. Thus, the tension in a portion of the intermediate transfer belt 30 closer to the front surface is larger than the tension in a portion of the intermediate transfer belt 30 closer to the rear surface.

After correcting the relative position between the intermediate transfer belt 30 and the rotation shaft 33A of the driving roller 33, the relative position adjuster 263 drives the driving motor 33B and rotates the driving roller 33. Thus, the intermediate transfer belt 30 rotates. The intermediate transfer belt 30 moves in the front-surface direction or the rear-surface direction while receiving motive power from the driving roller 33 and rotating.

The relative position adjuster 263 rotates the driving roller 33 at a second rotation speed higher than a first rotation speed of the driving roller 33 for the developing state. Thus, because the movement speed of the intermediate transfer belt 30 is faster than that in the developing state, a period of time required to move the intermediate transfer belt 30 to the reference position can be shortened. The second rotation speed is preferably a rotation speed corresponding to an upper limit speed at which the intermediate transfer belt 30 can rotate around the driving roller 33, the driven roller 34 and the tension rollers 61, 63. Thus, the period of time required to move the intermediate transfer belt 30 to the reference position can be the shortest. The maximum rotation speed allowed for the driving roller 33 is defined by experiment or simulation and stored in the HDD 115.

The point in time at which the driving motor 33B is driven is not limited to after the relative position between the intermediate transfer belt 30 and the rotation shaft 33A of the driving roller 33 is corrected, and may be before the relative position between the intermediate transfer belt 30 and the rotation shaft 33A of the driving roller 33 is corrected.

The timing determiner 253 determines the deviation between the reference line and the reference position based on a light receiving amount received from the sensor 71 after outputting the adjustment instruction. The timing determiner 253 determines a point in time at which the distance between the reference line and the reference position becomes equal to or smaller than a threshold value TL as a point in time at which the position adjustment controller 251 stops adjusting the position of the rotation shaft 34A. The timing determiner 253 outputs a stop instruction to the position adjustment controller 251 in response to the distance between the reference line and the reference position becoming equal to or smaller than the threshold value TL.

The position adjustment controller 251 stops the driving motor 34B in response to reception of the stop instruction. Further, the position adjustment controller 251 corrects the relative position of the intermediate transfer belt 30 with respect to the driving roller 33 such that the tension of the intermediate transfer belt 30 is the first tension. Specifically, the position adjustment controller 251 rotates each of the cam 77 supported by the support plate 81A and the cam 77 pivotally supported by the support plate 81B to the position of the rotation angle of 0 degrees. Thus, the both end portions of the rotation shaft 34A of the driven roller 34 are respectively located at the image forming positions, and the tension of the intermediate transfer belt 30 is the first tension.

Figure 12:
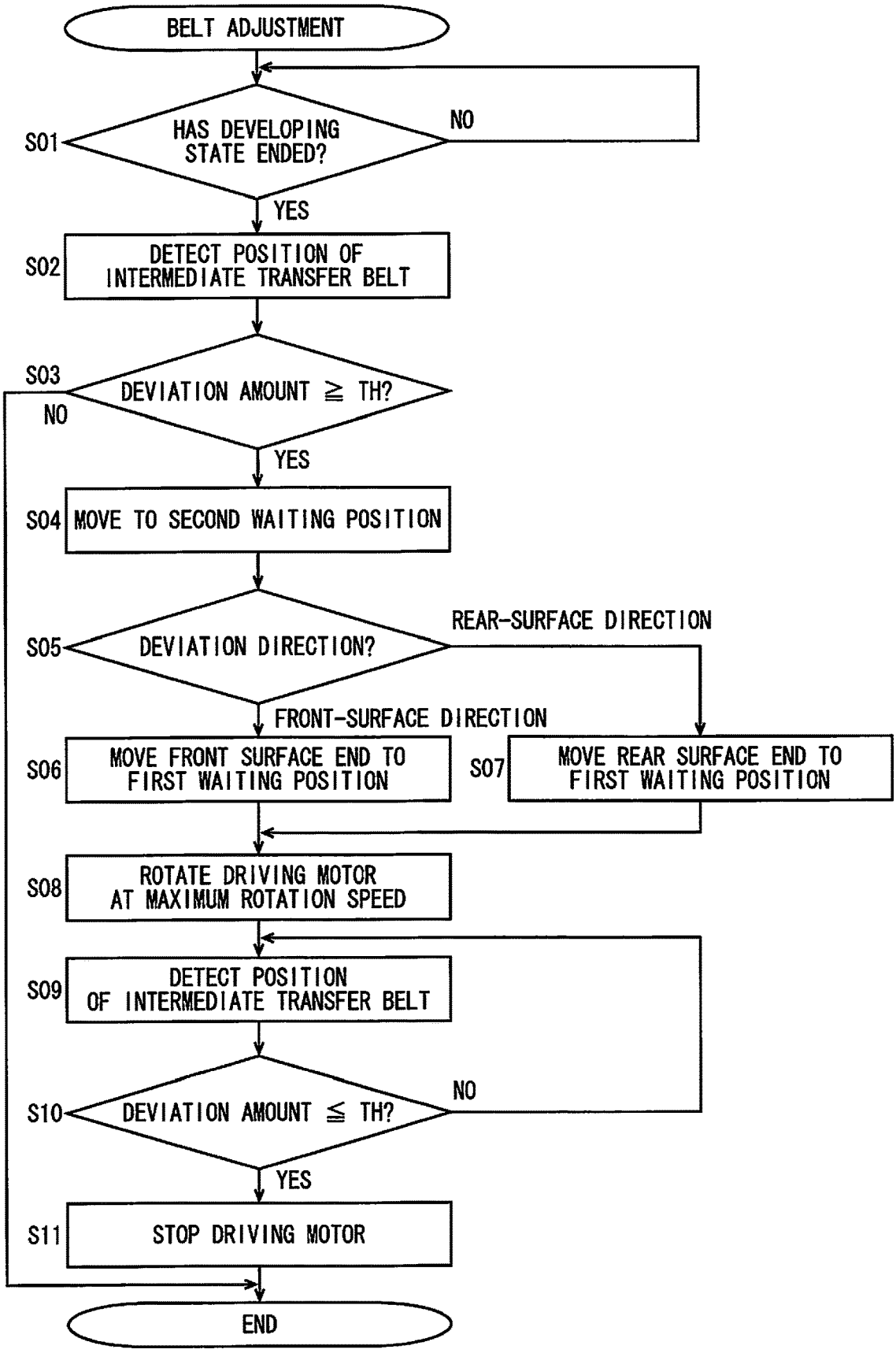
FIG. 12 is a flowchart showing one example of a flow of a belt adjustment process in the present embodiment.

FIG. 12 is a flowchart showing one example of a flow of a belt adjustment process in the present embodiment. The process shown in FIG. 12 is a process executed by the CPU in a case in which the CPU included in the printer 100 executes the belt adjustment program stored in the ROM 113, the HDD 115 or the CD-ROM 118. Referring to FIG. 12, the CPU 111 included in the printer 100 determines whether the developing state has ended (step S01). The process waits until an image forming operation performed by the image forming unit 140 ends (NO in the step S01). When the image forming operation performed by the image forming unit 140 ends (YES in the step S01), the process proceeds to the step S02.

In the step S02, the position of the intermediate transfer belt 30 is detected, and the process proceeds to the step S03. The position of the reference line is detected based on a light receiving amount output from the sensor 71. The reference line indicates the end portion of the intermediate transfer belt 30 closer to the front surface.

In the step S03, whether the deviation amount is equal to or larger than the threshold value TH is determined. A deviation amount is the distance between the reference line and the reference position. If a deviation amount is equal to or larger than the threshold value TH, the process proceeds to the step S04. If not, the belt adjustment process ends. In the step S04, the both end portions of the rotation shaft 34A of the driven roller 34 are moved to the second waiting positions, and the process proceeds to the step S05. Each of the cam 77 supported by the support plate 81A and the cam 77 supported by the support plate 81B is rotated to the position of the rotation angle of 45 degrees. Thus, the tension of the intermediate transfer belt 30 is reduced from the first tension to the second tension.

In the step S05, the process branches depending on a deviation direction of the intermediate transfer belt 30. If a deviation direction is the front-surface direction, the process proceeds to step S06. If a deviation direction is the rear-surface direction, the process proceeds to the step S07. In the step S06, the front-surface end of the rotation shaft 34A of the driven roller 34 is moved to the first waiting position, and the process proceeds to the step S08. The cam 77 supported by the support plate 81A closer to the front surface is rotated to the position of the rotation angle of 90 degrees. On the other hand, in the step S07, the rear-surface end of the rotation shaft 34A of the driven roller 34 is moved to the first waiting position, and the process proceeds to the step S08. The cam 77 supported by the support plate 81B closer to the rear surface is rotated to the position of the rotation angle of 90 degrees.

In the step S08, the driving motor 33B is rotated at the maximum rotation speed, and the process proceeds to the step S09. The maximum rotation speed of the driving motor 33B is a rotation speed corresponding to the maximum rotation speed at which the intermediate transfer belt 30 can rotate. In the step S09, similarly to the step S02, the position of the intermediate transfer belt 30 is detected, and the process proceeds to the step S10.

In the step S10, whether the deviation amount is equal to or smaller than the threshold value TL is determined. If the deviation amount is equal to or smaller than the threshold value TL, the process proceeds to the step S12. If not, the process returns to the step S10. In the step S12, the driving motor 33B stops, and the process ends. The driving motor 33B rotates until the deviation amount becomes equal to or smaller than the threshold value TL.

In the above-mentioned embodiment, in order to correct the relative position between the intermediate transfer belt 30 and the driven roller 34, the distance between one of the both end portions of the driven roller 34 and the rotation shaft 33A of the driving roller 33 is made shorter than the distance between the other end portion and the rotation shaft 33A of the driving roller 33. Therefore, the distance by which the one end portion of the driven roller 34 is moved in the horizontal direction is different from the distance by which the other end portion of the driven roller 34 is moved in the horizontal direction. The direction in which the both end portions of the driven roller 34 are moved does not have to be the horizontal direction.

First Modified Example

In a first modified example, the direction in which the both end portions of the driven roller 34 are moved in order to correct the relative position between the intermediate transfer belt 30 and the driven roller 34 is the vertical direction.

Figure 13:
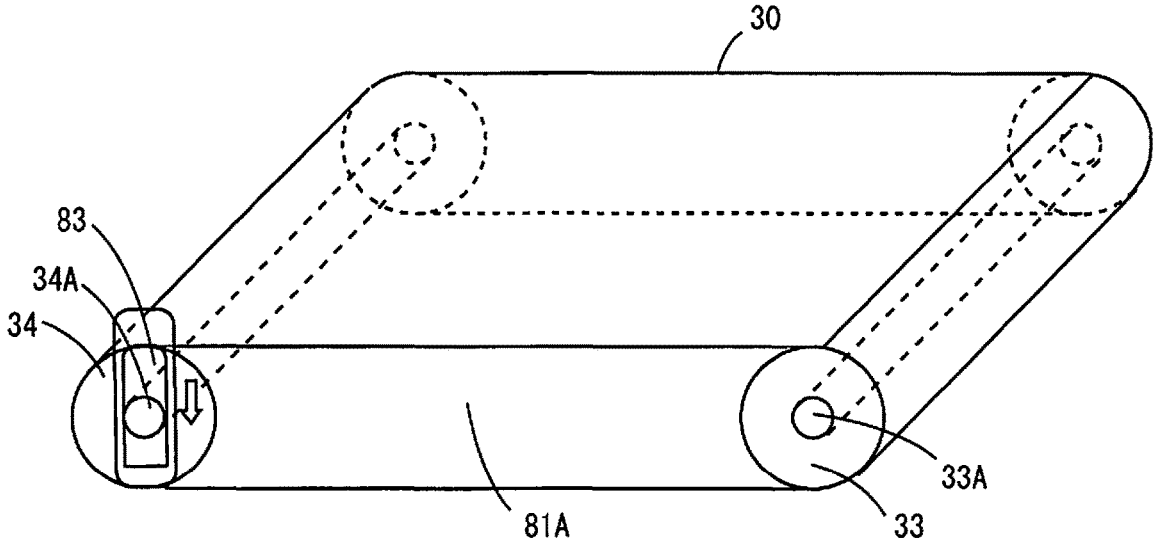
FIG. 13 is a schematic view for explaining the relative positions of the driving roller and the driven roller relative to each other and the moving direction of the intermediate transfer belt in a first modified example.

FIG. 13 is a schematic view for explaining the relative positions of the driving roller and the driven roller relative to each other and a moving direction of the intermediate transfer belt in the first modified example. FIG. 13 shows the both end portions of the rotation shaft 34A of the driven roller 34 being located at the second waiting positions. The both end portions of the rotation shaft 34A of the driven roller 34 are guided by the sliding holes 83 so as to be movable in the vertical direction. In the first modified example, the first waiting positions are lower than the second waiting positions.

In a case in which the front-surface end of the rotation shaft 34A of the driven roller 34 is located at the first waiting position, and the rear-surface end thereof is located at the second waiting position, the rotation shaft 34A of the driven roller 34 and the rotation shaft 33A of the driving roller 33 have a twisted positional relationship. Therefore, the tension of the intermediate transfer belt 30 is larger in a portion thereof closer to the front surface than a portion thereof closer to the rear surface. In this state, when the driving roller 33 rotates, the intermediate transfer belt 30 moves in the front-surface direction.

Contrary to the position of the rotation shaft 34A f the driven roller 34 shown in FIG. 13, in a case in which the front-surface end of the rotation shaft 34A of the driven roller 34 is located at the second waiting position, and the rear-surface end thereof is located at the first waiting position, the rotation shaft 34A of the driven roller 34 and the rotation shaft 33A of the driving roller 33 have a twisted positional relationship. Therefore, the tension of the intermediate transfer belt 30 is larger in a portion thereof closer to the rear surface than in a portion thereof closer to the front surface. In this state, when the driving roller 33 rotates, the intermediate transfer belt 30 moves in the rear-surface direction.

Although the first waiting position is lower than the second waiting position in the first modified example, the first waiting position may be higher than the second waiting position. Further, in the first modified example, in order to reduce the tension of the intermediate transfer belt 30 from the first tension to the second tension, it is necessary to move the both end portions of the rotation shaft 34A of the driven roller 34 from the image forming positions to the second waiting positions. The configuration in the above-mentioned embodiment is adopted as the configuration for moving the both end portions of the rotation shaft 34A of the driven roller 34 from the image forming positions to the second waiting positions.

Second Modified Example

In a second modified example, the direction in which the both end portions of the driven roller 34 are moved in order to correct the relative position between the intermediate transfer belt 30 and the driven roller 34 is the oblique direction between the vertical direction and the horizontal direction.

Figure 14:
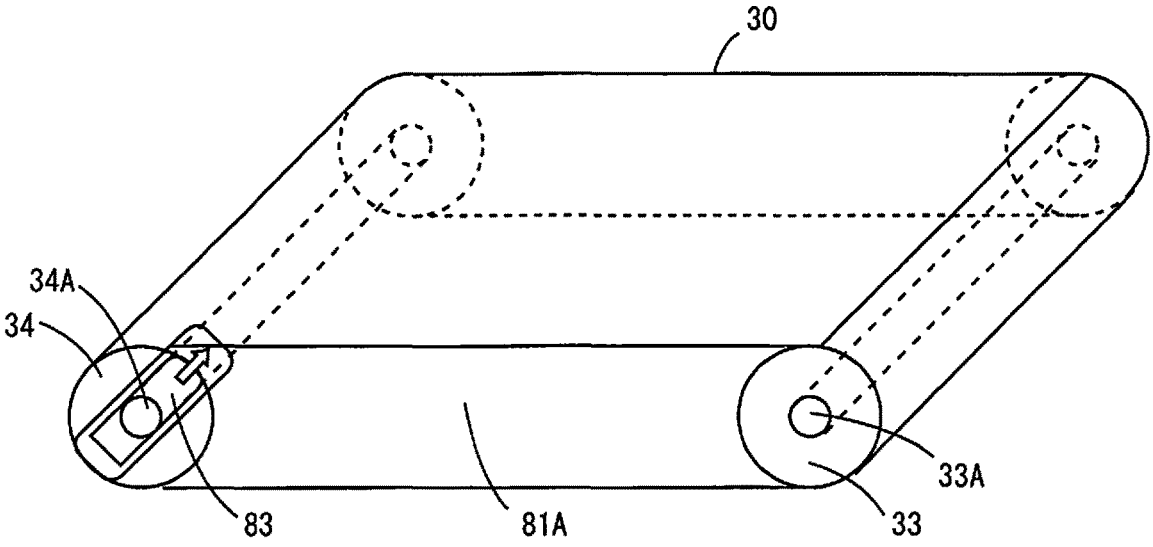
FIG. 14 is a schematic diagram for explaining the relative position between the driving roller and the driven roller and the moving direction of the intermediate transfer belt in a second modified example.

FIG. 14 is a schematic diagram for explaining the relative positions of the driving roller and the driven roller relative to each other and the moving direction of the intermediate transfer belt in the second modified example. FIG. 14 shows the both end portions of the rotation shaft 34A of the driven roller 34 being located at the second waiting positions. The both end portions of the rotation shaft 34A of the driven roller 34 are guided by the sliding holes 83 so as to be movable in an obliquely upward direction. In the second modified example, the first waiting positions are higher and closer to the rotation shaft 33A of the driving roller 33 than the second waiting positions.

In a case in which the front-surface end of the rotation shaft 34A of the driven roller 34 is located at the first waiting position and the rear-surface end thereof is located at the second waiting position, the rotation shaft 34A of the driven roller 34 and the rotation shaft 33A of the driving roller 33 have a twisted positional relationship. Therefore, the tension of the intermediate transfer belt 30 is larger in a portion thereof closer to the rear surface than in a portion thereof closer to the front surface. In this state, when the driving roller 33 rotates, the intermediate transfer belt 30 moves in the rear-surface direction.

Contrary to the position of the rotation shaft 34A of the driven roller 34 shown in FIG. 14, in a case in which the front-surface end of the rotation shaft 34A of the driven roller 34 is located at the second waiting position and the rear-surface end thereof is located at the first waiting position, the rotation shaft 34A of the driven roller 34 and the rotation shaft 33A of the driving roller 33 have a twisted positional relationship. Therefore, the tension of the intermediate transfer belt 30 is larger in a portion thereof closer to the front surface than a portion thereof closer to the rear surface. In this state, when the driving roller 33 rotates, the intermediate transfer belt 30 moves in the front-surface direction.

Although the first waiting positions are lower than the second waiting positions in the first modified example, the first waiting positions may be higher than the second waiting positions. Further, in the second modified example, in order to reduce the tension of the intermediate transfer belt 30 from the first tension to the second tension, it is necessary to move the both end portions of the rotation shaft 34A of the driven roller 34 from the image forming positions to the second waiting positions. The configuration in the above-mentioned embodiment is adopted as the configuration for moving the both end portions of the rotation shaft 34A of the driven roller 34 from the image forming positions to the second waiting positions.

Third Modified Example

In the above-mentioned embodiment, the timing determiner 253 determines a point in time at which the position adjustment controller 251 adjusts a position of the rotation shaft 34A based on a relative position of the intermediate transfer belt 30 with respect to the driving roller 33. In a third modified example, the timing determiner 253 determines a point in time at which the position adjustment controller 251 adjusts a position of the rotation shaft 34A based on a distance by which the intermediate transfer belt 30 has rotated.

The timing determiner 253 measures a rotation amount of the driving motor 33B and calculates a distance by which the intermediate transfer belt 30 has rotated based on the rotation amount. The timing determiner 253 determines a point in time at which the position adjustment controller 251 adjusts a position of the rotation shaft 34A in a case in which a distance by which the intermediate transfer belt 30 has rotated is equal to or larger than a predetermined distance threshold value. In this case, the threshold value TH is unnecessary. Further, it is not necessary to detect the relative position of the intermediate transfer belt 30 with respect to the driving roller 33 using the sensor 71.

The distance threshold value is defined in advance by experiment or simulation. The distance threshold value is defined based on the relationship between a distance by which the intermediate transfer belt 30 rotates and a deviation amount. Further, the distance threshold value may be different depending on a distance by which the intermediate transfer belt 30 rotates. For example, in a case in which the distance threshold value is set for the first time, because a degree of deterioration of the intermediate transfer belt 30 over time is low, the distance threshold value is set to a relatively high value. In a case in which the distance threshold value is set for the second time or after the second time, because a degree of deterioration of the intermediate transfer belt 30 over time increases, the distance threshold value is gradually set to a lower value as the number of times the distance threshold value is set increases.

Fourth Modified Example

The sensor 71 may be a sensor having one optoelectronic transducer in a light receiving surface extending in the front-and-rear direction. The larger the area in which a light receiver of the sensor 71 and the intermediate transfer belt 30 overlap with each other in the vertical direction, the more light is reflected from the intermediate transfer belt 30, and thus the larger a light receiving amount in the light receiver. The smaller the area in which the light receiver of the sensor 71 and the intermediate transfer belt 30 overlap with each other in the vertical direction, the smaller the light receiving amount. The sensor 71 outputs a detected light receiving amount to the CPU 111. The area in which the light receiver of the sensor 71 and the intermediate transfer belt 30 overlap with each other in the vertical direction and the light receiving amount of the light receiver of the sensor 71 have a predetermined relationship. Here, the area is proportional to the light receiving amount, by way of example. Here, the relationship between the area and the light receiving amount is obtained by measurement in experiment or simulation, and is stored in the HDD 115 as a table or a calculation formula defining the relationship between the area and the light receiving amount.

The timing determiner 253 determines the deviation between the reference line and the reference position based on a light receiving amount received from the sensor 71 at any point in time using the table or the calculation formula defining the relationship between the area and the light receiving amount. The timing determiner 253 determines a point in time at which the distance between the reference line and the reference position becomes equal to or larger than the threshold value TH as a point in time at which the position adjustment controller 251 adjusts a position of the rotation shaft 34A. The timing determiner 253 outputs an adjustment instruction to the position adjustment controller 251 in response to the distance between the reference line and the reference position becoming equal to or larger than the threshold value TH.

Further, the timing determiner 253 may store a reference light receiving amount obtained by measurement of a light receiving amount in advance when the intermediate transfer belt 30 is at the reference position in the HDD 115. In this case, a table or a calculation formula that defines the relationship between an area and a light receiving amount is unnecessary. The timing determiner 253 determines a point in time at which an absolute value of the difference between a light receiving amount received from the sensor 71 at any point in time and the reference light receiving amount becomes equal to or larger than an upper limit threshold value as a point in time at which the position adjustment controller 251 adjusts a position of the rotation shaft 34A. Further, the timing determiner 253 determines a point in time at which an absolute value of the difference between a light receiving amount received from the sensor 71 and the reference light receiving amount becomes equal to or smaller than a lower limit threshold value after that as a point in time at which the position adjustment controller 251 ends adjusting the position of the rotation shaft 34A. The upper threshold value is larger than the lower threshold value.

Fifth Modified Example

Further, although the elastic member 73 and the cam 77 are used to move the rotation shaft 34A of the driven roller 34, a direct-acting stepping motor including a ball screw and a stepping motor or a piston driven by an air or hydraulic pressure may be used instead of the elastic member 73 and the cam 77.

As described above, the printer 100 in the present embodiment functions as an image forming apparatus and includes the driving roller 33, the driven roller 34, the tension rollers 61, 63, the endless intermediate transfer belt 30 that is suspended over outer portions of the driving roller 33, the driven roller 34 and the tension rollers 61, 63, the developers 24Y, 24M, 24C, 24K that form toner images on the intermediate transfer belt, the driving motor 33B that rotates the driving roller 33, and the position adjustment mechanism 80 that corrects the relative positions of the driven roller 34 and the driving roller 33 relative to each other. The CPU 111 includes the position adjustment controller 251 that controls the position adjustment mechanism 80 to correct the relative position between the intermediate transfer belt 30 and the driving roller 33 with the tension applied to the intermediate transfer belt 30 being set to the second tension smaller than the first tension for the developing state. Therefore, with the tension applied to the intermediate transfer belt 30 being set to the second tension smaller than the first tension for the developing state, the frictional force between the driving roller 33 and the intermediate transfer belt 30 is reduced. This facilitates correction of the relative position between the driving roller 33 and the intermediate transfer belt 30 and shortens a period of time required to correct the relative position. This facilitates adjustment of the position of the intermediate transfer belt 30.

The position adjustment mechanism 80 includes a movement mechanism that corrects the distance between the rotation shaft 34A of the driven roller 34, which is the position adjustment roller, and the rotation shaft 33A of the driving roller 33. The position adjustment controller 251 includes a tension controller 261 that controls the position adjustment mechanism 80 to adjust the tension of the intermediate transfer belt 30 to the second tension. Therefore, the tension of the intermediate transfer belt 30 is easily adjusted.

Further, the position adjustment controller 251 controls the position adjustment mechanism 80 to make the movement amounts of both end portions of the rotation shaft 34A of the driven roller 34 be different from each other. Therefore, the relative position between the intermediate transfer belt 30 and the driving roller 33 is easily corrected.

Further, the printer 100 includes a sensor 71 that detects a relative position of a reference line parallel to the rotation direction of the intermediate transfer belt 30 with respect to the driving roller 33, and the position adjustment controller 251 corrects the relative position between the intermediate transfer belt 30 and the driving roller 33 based on the relative position detected by the sensor 71. Therefore, in a case in which the relative position between the intermediate transfer belt 30 and the driving roller 33 is changed, the relative position is corrected. Therefore, the position of the intermediate transfer belt 30 can be adjusted to a predetermined position with respect to the driving roller 33.

The timing determiner 253 included in the CPU 111 determines a point in time at which the relative position between the intermediate transfer belt 30 and the driving roller 33 is corrected based on a change amount of the relative position between the intermediate transfer belt 30 and the driving roller 33. Therefore, in a case in which the relative position between the intermediate transfer belt 30 and the driving roller 33 deviates from the reference position by a predetermined amount, the relative position between the intermediate transfer belt 30 and the driving roller 33 is corrected. Therefore, the relative position between the intermediate transfer belt 30 and the driving roller 33 can be adjusted at an appropriate time.

During a period in which the relative position between the intermediate transfer belt 30 and the driving roller 33 is adjusted by the position adjustment controller 251, the driving motor 33B rotates the driving roller 33 at a second rotation speed higher than the first rotation speed for the developing state. The relative position between the intermediate transfer belt 30 and the driving roller 33 is adjusted while the driving roller 33 is rotated at the second rotation speed higher than the first rotation speed for the developing state. Therefore, a period of time required to adjust the relative position between the intermediate transfer belt 30 and the driving roller 33 can be shortened.

In particular, the second rotation speed may be a rotation speed corresponding to the highest rotation speed at which the intermediate transfer belt 30 can rotate. In this case, a period of time required to adjust the relative position between the intermediate transfer belt 30 and the driving roller 33 can be shortened.

Further, in the third modified example, the timing determiner 253 determines a point in time at which the relative position between the intermediate transfer belt 30 and the driving roller 33 is corrected based on a distance by which the intermediate transfer belt 30 has rotated. Each time the intermediate transfer belt 30 rotates by a predetermined distance, the relative position between the intermediate transfer belt 30 and the driving roller 33 is corrected. Therefore, the relative position between the intermediate transfer belt 30 and the driving roller 33 can be adjusted at an appropriate time.

Second Embodiment

A printer 100 in a second embodiment is configured such that an intermediate transfer belt 30 moves in either a front-surface direction or a rear-surface direction in a developing state and the intermediate transfer belt moves in the other direction in an adjusting state that is not the developing state. Differences of the printer 100 in the second embodiment from the printer 100 in the first embodiment will be mainly described below. Here, the printer 100 in the second embodiment is configured such that the intermediate transfer belt 30 moves in the front-surface direction in the developing state and the intermediate transfer belt 30 moves in the rear-surface direction in the adjusting state that is not the developing state, by way of example. The printer 100 in the second embodiment does not include the sensor 71.

In the printer 100 in the second embodiment, a driven roller 34 has a truncated cone shape. In regard to the cross section perpendicular to a rotation shaft 34A of the driven roller 34, the radius of the cross section in the front-surface direction is larger than the radius of the cross section in the rear-surface direction. Therefore, the tension of the intermediate transfer belt 30 is larger in a portion thereof closer to the front surface than a portion thereof closer to the rear surface. The rotation shaft 34A of the driven roller 34 is parallel to a rotation shaft 33A of a driving roller 33. The driving roller 33 has a columnar shape. Therefore, the intermediate transfer belt 30 moves in the front-surface direction in the developing state.

Figure 15:
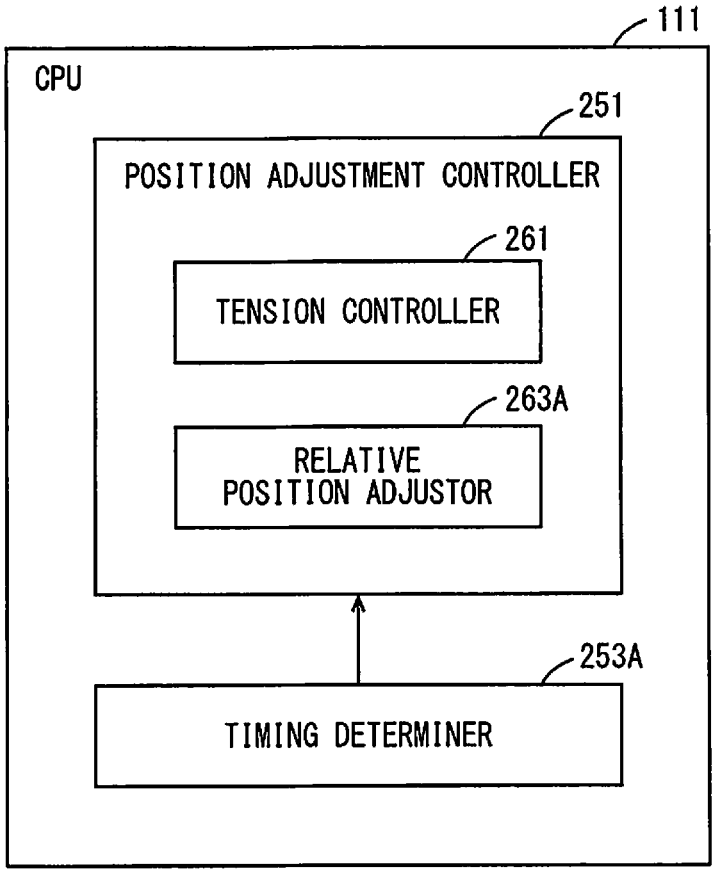
FIG. 15 is a block diagram showing one example of the functions of a CPU included in a printer in a second embodiment.

FIG. 15 is a block diagram illustrating one example of functions of a CPU included in the printer in the second embodiment. Difference of the functions shown in FIG. 15 from the functions shown in FIG. 11 are that the relative position adjuster 263 and the timing determiner 253 are respectively changed to a relative position adjuster 263A and a timing determiner 253A. The other functions are the same as the functions shown in FIG. 11. A description therefore will not be repeated.

The timing determiner 253A determines a point in time at which a position adjustment controller 251 adjusts a position of the rotation shaft 34A based on a distance by which the intermediate transfer belt 30 has rotated. The timing determiner 253A measures a rotation amount of the driving motor 33B and calculates a distance by which the intermediate transfer belt 30 has rotated based on the rotation amount. The timing determiner 253A determines a point in time at which the position adjustment controller 251 adjusts the position of the rotation shaft 34A in a case in which the distance by which the intermediate transfer belt 30 has rotated is equal to or larger than a predetermined distance threshold value.

The distance threshold value is defined in advance by experiment or simulation. The distance threshold value is defined based on the relationship between a distance by which the intermediate transfer belt 30 rotates and a deviation amount. Further, the distance threshold value may be different depending on a distance by which the intermediate transfer belt 30 rotates. For example, in a case in which the distance threshold value is set for the first time, because a degree of deterioration of the intermediate transfer belt 30 over time is low, the distance threshold value is set to a relatively high value. In a case in which the distance threshold value is set for the second time or after the second time, because a degree of deterioration of the intermediate transfer belt 30 over time increases, the distance threshold value is gradually set to a smaller value as the number of times the threshold value is set increases.

The position adjustment controller 251 corrects the relative position of the intermediate transfer belt 30 with respect to the driving roller 33 in response to receiving an adjustment instruction from the timing determiner 253A. The position adjustment controller 251 includes a tension controller 261 and a relative position adjuster 263A.

In response to receiving the adjustment instruction from the timing determiner 253A, the relative position adjuster 263A corrects the relative position between the intermediate transfer belt 30 and the rotation shaft 33A of the driving roller 33. Specifically, the relative position adjuster 263A rotates one of a cam 77 supported by a support plate 81A and a cam 77 supported by a support plate 81B to a position of the rotation angle of 90 degrees. The relative position adjuster 263A selects one of the cam 77 supported by the support plate 81A and the cam 77 supported by the support plate 81B based on a deviation direction included in the adjustment instruction. Here, because the intermediate transfer belt 30 is configured to move in the front-surface direction in the developing state, the relative position adjuster 263A selects the cam 77 supported by the support plate 81A.

The relative position adjuster 263A rotates the cam 77 supported by the support plate 81A closer to the front surface to the position of the rotation angle of 90 degrees. Thus, because the tension in a portion of the intermediate transfer belt 30 closer to the rear surface is larger than the tension in a portion of the intermediate transfer belt 30 closer to the front surface, the intermediate transfer belt 30 moves in the rear-surface direction while being rotated by the driving roller 33.

After correcting the relative position between the intermediate transfer belt 30 and the rotation shaft 33A of the driving roller 33, the relative position adjuster 263A drives the driving motor 33B for a predetermined period of time and stops the driving motor 33B after the predetermined period of time elapses. Thus, the intermediate transfer belt 30 rotates for a predetermined period of time. The predetermined period of time is a period of time required to move the intermediate transfer belt 30 by a predetermined distance in the rear-surface direction. The predetermined period of time is a period that is defined in advance by experiment or simulations. The predetermined period of time is stored in the HDD 115. The intermediate transfer belt 30 moves in the rear-surface direction while being rotated by motive power transmitted from the driving roller 33.

The relative position adjuster 263A rotates the driving roller 33 at the second rotation speed higher than the first rotation speed of the driving roller 33 in the developing state. Thus, because the movement speed of the intermediate transfer belt 30 is increased, a period of time required to move the intermediate transfer belt 30 by a predetermined distance in the rear-surface direction can be shortened. The second rotation speed is preferably a rotation speed corresponding to a maximum rotation speed at which the intermediate transfer belt 30 can rotate. Thus, the period of time required to move the intermediate transfer belt 30 in the rear-surface direction can be the shortest. The maximum rotation speed allowed for rotating the intermediate transfer belt 30 is defined by experiment or simulation and stored in the HDD 115.

A point in time at which the driving motor 33B is driven is not limited to after the relative position between the intermediate transfer belt 30 and the rotation shaft 33A of the driving roller 33 is corrected but may be before the relative position between the intermediate transfer belt 30 and the rotation shaft 33A of the driving roller 33 is corrected.

In the printer 100 in the second embodiment, as shown in FIG. 10, the front-surface end of the rotation shaft 34A of the driven roller 34 is located at a first waiting position, and the rear-surface end is located at a second waiting position. In this case, the rotation shaft 34A of the driven roller 34 and the rotation shaft 33A of the driving roller 33 have a twisted positional relationship. Further, the tension of the intermediate transfer belt 30 is smaller in a portion closer to the front surface than a portion closer to the rear surface. In this state, when the driving roller 33 rotates, the intermediate transfer belt 30 moves in the rear-surface direction.

The printer 100 in the second embodiment may include the sensor 71, and may detect a direction in which a reference line of the intermediate transfer belt 30 has deviated from a reference position and a deviation amount by which the reference line of the intermediate transfer belt 30 has deviated from the reference position. In this case, the relative position between the intermediate transfer belt 30 and the driving roller 33 may be corrected in response to the deviation amount becoming equal to or larger than a threshold value TH. Further, the correction of the relative position between the intermediate transfer belt 30 and the driving roller 33 may be stopped in response to the deviation amount becoming equal to or smaller than the threshold value TL.

In the printer 100 in the second embodiment, the driven roller 34 is configured to have the suspended intermediate transfer belt 30 such that the relative position between the intermediate transfer belt 30 and the driving roller 33 changes from a reference position in a first direction (one of the front-surface direction and the rear-surface direction) toward a first relative position. The position adjustment controller 251 adjusts the relative position between the intermediate transfer belt 30 and the driving roller 33 such that the relative position between the intermediate transfer belt 30 and the driving roller 33 changes in a second direction toward a second relative position opposite to the first relative position with respect to the reference position. Therefore, the relative positions change in the first direction with the relative position between the intermediate transfer belt 30 and the driving roller 33 not adjusted, and the relative positions change in the second direction when the relative position between the intermediate transfer belt 30 and the driving roller 33 is adjusted. Therefore, the intermediate transfer belt 30 can be positioned between the first relative position and the second relative position with respect to the driving roller 33.

Third Embodiment

In a case in which the rotation shaft 34A of the driven roller 34 and the rotation shaft 33A of the driving roller 33 are parallel to each other, the probability that the intermediate transfer belt 30 moves in the front-surface direction and the probability that the intermediate transfer belt 30 moves in the rear-surface direction in the developing state are respectively 50%. A printer 100 in a third embodiment alternately moves an intermediate transfer belt in either the front-surface direction and the rear-surface direction by a moving period of time each time a switching period of time elapses. Further, the printer 100 in the third embodiment does not include the sensor 71.

The switching period of time is an accumulated period of time during which the intermediate transfer belt 30 rotates in a developing state and is a predetermined period of time. The moving period of time is a period of time required to move the intermediate transfer belt 30 and is a predetermined period of time. A moving amount of the intermediate transfer belt 30 in the switching period of time is smaller than a moving amount of the intermediate transfer belt 30 in the moving period of time. In this manner, the printer 100 in the third embodiment is adjusted such that a reference line of the intermediate transfer belt 30 is closer to a reference position.

The printer 100 in the third embodiment may include the sensor 71, and may detect a direction in which the reference line of the intermediate transfer belt 30 has deviated from the reference position and a deviation amount by which the reference line of the intermediate transfer belt 30 has deviated from the reference position. In this case, the relative position between the intermediate transfer belt 30 and the driving roller 33 may be corrected in response to the deviation amount becoming equal to or larger than a threshold value TH. In this case, the switching period of time is unnecessary. Further, correction of the relative position between the intermediate transfer belt 30 and the driving roller 33 may be stopped in response to the deviation amount becoming equal to or smaller than the threshold value TL. In this case, the moving period of time is unnecessary.

In the printer 100 in the third embodiment, the position adjustment controller 251 corrects the relative position between the intermediate transfer belt 30 and the driving roller 33 in a direction opposite to a direction in which the relative position between the intermediate transfer belt 30 and the driving roller 33 is previously corrected. Therefore, each time the relative position between the intermediate transfer belt 30 and the driving roller 33 is corrected, the direction in which the relative positions are corrected is opposite to a direction in which the relative positions are previously corrected. Therefore, the position of the intermediate transfer belt 30 can be adjusted to a predetermined position with respect to the driving roller 33.

While the printer 100 is described as one example of an image forming apparatus in the present embodiment, the image forming apparatus may be a copying machine, a laser beam printer, a facsimile machine, a Multi Function Peripheral combining these or the like.

While the printer 100 that forms a tandem color image is described as one example of an image forming apparatus in the present embodiment, the present invention is not limited to this. An image forming apparatus may be an image forming apparatus that forms a monochrome image. The configurations and arrangements of the image forming units 20Y, 20M, 20C, 20K, the exposure devices 21Y, 21M, 21C, 21K, the charging rollers 22Y, 22M, 22C, 22K, the photoreceptor drums 23Y, 23, 23C, 23K, the developers 24Y, 24M, 24C, 24K, the primary transfer rollers 25Y, 25M, 25C, 25K, the secondary transfer roller 26 and the fuser device 50 are not limited to the present embodiment and may have other configurations and arrangements.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming apparatus comprising:

a plurality of rollers;

an endless belt that is suspended over outer portions of the plurality of rollers;

a developer that forms a toner image on the belt;

a driver that rotates at least one driving roller out of the plurality of rollers;

a position adjustment mechanism that corrects relative positions of the plurality of rollers relative to one another; and a hardware processor, wherein the hardware processor controls the position adjustment mechanism to correct a relative position between the belt and the driving roller with tension applied to the belt being a second tension smaller than a first tension that is applied in a developing state in which a toner image is formed on the belt by the developer.

2. The image forming apparatus according to claim 1, comprising a movement mechanism that corrects a distance between a rotation shaft of at least one position adjustment roller out of the plurality of rollers and a rotation shaft of the driving roller, wherein the hardware processor controls the position adjustment mechanism to make tension of the belt be the second tension.

3. The image forming apparatus according to claim 2, wherein the hardware processor controls the position adjustment mechanism to make movement amounts of both ends of the rotation shaft of the position adjustment roller be different from each other.

4. The image forming apparatus according to claim 1, further comprising a position detector that detects a relative position of a reference line parallel to a rotation direction of the belt with respect to the driving roller, wherein the hardware processor corrects a relative position between the belt and the driving roller based on a relative position detected by the position detector.

5. The image forming apparatus according to claim 1, wherein the plurality of rollers are configured to have the belt suspended over the plurality of rollers such that a relative position between the belt and the driving roller changes in a first direction directed from a reference position toward a first relative position, and the hardware processor adjusts a relative position between the belt and the driving roller such that the relative position between the belt and the driving roller changes in a second direction directed toward a second relative position opposite to the first relative position with respect to the reference position.

6. The image forming apparatus according to claim 1, wherein the hardware processor corrects a relative position between the belt and the driving roller in a direction opposite to a direction in which the relative position between the belt and the driving roller is corrected previously.

7. The image forming apparatus according to claim 1, wherein the hardware processor determines a point in time at which a relative position between the belt and the driving roller is corrected based on a change amount in regard to the relative position between the belt and the driving roller.

8. The image forming apparatus according to claim 1, wherein the hardware processor determines a point in time at which a relative position between the belt and the driving roller is corrected based on a distance by which the belt has rotated.

9. The image forming apparatus according to claim 1, wherein the driver rotates the driving roller at a second rotation speed faster than a first rotation speed for the developing state during a period in which a relative position between the belt and the driving is adjusted by the position adjustment controller.

10. The image forming apparatus according to claim 9, wherein the second rotation speed is a maximum speed corresponding to an upper limit speed at which the belt is rotatable.

11. A belt adjustment method of adjusting an image forming apparatus, the image forming apparatus comprising:

a plurality of rollers;

an endless belt that is suspended over the plurality of rollers;

a developer that forms a toner image on the belt;

a driver that rotates at least one driving roller out of the plurality of rollers; and a position adjustment mechanism that corrects relative positions of the plurality of rollers relative to one another, and the belt adjustment method causing the image forming apparatus to perform a position adjustment step of controlling the position adjustment mechanism to correct a relative position between the belt and the driving roller with tension applied to the belt being a second tension smaller than a first tension that is applied in a developing state in which a toner image is formed on the belt by the developer.

12. The belt adjustment method according to claim 11, wherein the position adjustment mechanism further includes a movement mechanism that corrects a distance between a rotation shaft of at least one position adjustment roller out of the plurality of rollers and a rotation shaft of the driving roller, and the position adjustment step includes controlling the position adjustment mechanism to make tension of the belt be the second tension.

13. The belt adjustment method according to claim 12, wherein the position adjustment step includes controlling the position adjustment mechanism to make movement amounts of both ends of the rotation shaft of the position adjustment roller be different from each other.

14. The belt adjustment method according to claim 11, further including a position detection step of detecting a relative position of a reference line parallel to a rotation direction of the belt with respect to the driving roller, wherein the position adjustment step includes correcting a relative position between the belt and the driving roller based on a relative position detected by the position detector.

15. The belt adjustment method according to claim 11, wherein the plurality of rollers are configured to have the belt suspended over the plurality of rollers such that relative position of the belt and the driving roller changes in a first direction directed from a reference position toward a first relative position, and the position adjustment step includes adjusting a relative position between the belt and the driving roller such that the relative position between the belt and the driving roller changes in a second direction directed toward a second relative position opposite to the first relative position with respect to the reference position.

16. The belt adjustment method according to claim 11, wherein the position adjustment step includes correcting a relative position between the belt and the driving roller in a direction opposite to a direction in which the relative position between the belt and the driving roller is corrected previously.

17. The belt adjustment method according to claim 11, further including a timing determining step of determining a point in time at which a relative position between the belt and the driving roller is corrected based on a change amount in regard to the relative position between the belt and the driving roller.

18. The belt adjustment method according to claim 11, further including a timing determining step of determining a point in time at which a relative position between the belt and the driving roller is corrected based on a distance by which the belt has rotated.

19. The belt adjustment method according to claim 11, wherein the driver rotates the driving roller at a second rotation speed faster than a first rotation speed for the developing state during a period in which a relative position between the belt and the driving roller is adjusted in the position adjustment step.

20. The image forming apparatus according to claim 19, wherein the second rotation speed is a maximum speed corresponding to an upper limit speed at which the belt is rotatable.

21. A non-transitory computer-readable recording medium encoded with a belt adjustment program executed in a computer controlling an image forming apparatus, the image forming apparatus comprising:

a plurality of rollers;

an endless belt that is suspended over the plurality of rollers;

a developer that forms a toner image on the belt;

a driver that rotates at least one driving roller out of the plurality of rollers; and a position adjustment mechanism that corrects relative positions of the plurality of rollers relative to one another, and the belt adjustment program causing the computer to perform a position adjustment step of controlling the position adjustment mechanism to correct a relative position between the belt and the driving roller with tension applied to the belt being a second tension smaller than a first tension that is applied in a developing state in which a toner image is formed on the belt by the developer.

* * * * *